US008365449B2

(12) United States Patent
Gimpel et al.

(10) Patent No.: US 8,365,449 B2
(45) Date of Patent: Feb. 5, 2013

(54) CONFIGURABLE LARGE-DEPTH PANEL DISPLAY

(75) Inventors: Dixon Gimpel, Prior Lake, MN (US); Mark Fritsche, Eagan, MN (US); Scott Parizek, Lakeville, MN (US); John Elliott, Eagan, MN (US)

(73) Assignee: Skyline Displays, Inc., Eagan, MN (US)

( * ) Notice: Subject to any disclaimer, the term of this patent is extended or adjusted under 35 U.S.C. 154(b) by 149 days.

(21) Appl. No.: 12/727,157

(22) Filed: Mar. 18, 2010

(65) Prior Publication Data

US 2010/0236116 A1 Sep. 23, 2010

Related U.S. Application Data

(60) Provisional application No. 61/162,239, filed on Mar. 20, 2009.

(51) Int. Cl.
*G09F 7/00* (2006.01)

(52) U.S. Cl. ..... 40/605; 52/239; 160/351

(58) Field of Classification Search ..... 40/605, 40/606.01–606.07; 211/204, 103, 193, 189, 211/206, 94.01, 198, 199, 207
See application file for complete search history.

(56) References Cited

U.S. PATENT DOCUMENTS 3,480,313 A * 11/1969 Halko, Jr. ..... 403/295
3,645,569 A * 2/1972 Reilly ..... 403/4
4,217,714 A * 8/1980 Ramsay ..... 40/549
4,507,887 A * 4/1985 Seely ..... 40/610
4,545,142 A * 10/1985 Whisnant ..... 40/605
4,774,792 A * 10/1988 Ballance ..... 52/285.2
4,953,338 A 9/1990 Wilson et al.
5,090,145 A * 2/1992 Chiang et al. ..... 40/605
5,125,193 A 6/1992 Beaulieu
5,265,358 A * 11/1993 Borod ..... 40/782
5,442,871 A * 8/1995 Sarkisian et al. ..... 40/606.17
5,486,391 A 1/1996 Tyner
5,495,952 A 3/1996 Kainz
5,537,766 A * 7/1996 Nickens et al. ..... 40/605
5,561,960 A 10/1996 Minnick et al.
5,617,660 A 4/1997 Pollack
5,768,845 A 6/1998 Beaulieu
5,875,596 A 3/1999 Muller
5,903,993 A * 5/1999 Maticko et al. ..... 40/757
5,987,794 A 11/1999 Lavi et al.
6,141,926 A 11/2000 Rossiter
6,152,581 A * 11/2000 Masters et al. ..... 362/362
6,161,320 A 12/2000 Peterson
6,466,369 B1 10/2002 Maddock
6,543,164 B1 4/2003 Sperl et al.
6,615,562 B2 9/2003 Fritsche et al.
(Continued)

*Primary Examiner* — Tashiana Adams
*Assistant Examiner* — Shin Kim
(74) *Attorney, Agent, or Firm* — Larkin Hoffman Daly & Lindgren Ltd.; Thomas J. Oppold

(57) ABSTRACT

A configurable large-depth panel display uses a number of frame members and a number of corner brackets coupled to one another to create an flexible and easily customized display device. The frame members relatively uniform, having a substantially constant cross-sectional configuration which is easily coupled to the frame members. The corner brackets can be configured in a number of different ways to produce a display product with a desired configuration. More specifically, the corner brackets can be configured to attach to frame members in a manner which produce an overall framework having multiple shapes and orientations, depending upon the desired design of the overall display. Various panels, brackets and supports can be easily attached to the frame members using integral portions of the constant cross-sectional configuration. Further, more complex displays can be easily created by simply attaching different framework components to one another thus creating a single structure with multiple panel members.

16 Claims, 27 Drawing Sheets

U.S. PATENT DOCUMENTS

| | | | | |
|---|---|---|---|---|
| 6,658,776 | B1 * | 12/2003 | Pynenburg et al. | 40/605 |
| 6,712,118 | B2 * | 3/2004 | Nussdorf | 160/351 |
| 6,712,229 | B2 | 3/2004 | Fritsche et al. | |
| 6,928,762 | B1 * | 8/2005 | Fattahi | 40/741 |
| 7,024,834 | B2 | 4/2006 | Gimpel et al. | |
| 7,040,064 | B2 | 5/2006 | Fritsche et al. | |
| 7,143,553 | B2 | 12/2006 | Fritsche et al. | |
| 7,866,369 | B2 * | 1/2011 | Domolato | 160/351 |
| 2003/0089057 | A1 | 5/2003 | Wiechecki | |
| 2008/0104907 | A1 | 5/2008 | Glick | |
| 2009/0007473 | A1 | 1/2009 | Gimpel et al. | |
| 2009/0031664 | A1 | 2/2009 | Gimpel et al. | |

* cited by examiner

CONFIGURABLE LARGE-DEPTH PANEL DISPLAY

CROSS-REFERENCE TO RELATED APPLICATIONS

This application claims the benefit of previously filed U.S. Provisional application 61/162,239, filed Mar. 20, 2009 and entitled "Configurable Large Depth Panel Display".

BACKGROUND

It is common to have self-supported "island" displays within tradeshows booths and in retail stores on which products and promotional materials are showcased. Often such island displays are specially designed for the exhibitor or retailer and can be quite expensive. Because island displays are intended to be placed in an area where visitors can view the display from all sides, the displays generally present a pleasing, finished, appearance from all sides. Additionally, these "double-sided" self-supporting displays generally have a depth of several inches, partly for aesthetics to give the display a more permanent and substantial appearance, and partly for functional or utilitarian reasons. For example, a large depth display enables internal beams or brackets to be placed between the front and rear panels for supporting shelves, fixtures or other appurtenances. Additionally, the large depth allows electrical wires to be hidden between the front and rear panels. Another advantage of large depth displays is that lighting can be placed within the interior to permit backlighting of the face panels.

Exhibitors and retailers often desire to periodically change the configuration or other design features of their displays to vary the look in order to showcase specific products, influence a particular audience, or for other creative and aesthetic reasons. However, with specially designed displays, the ability for the exhibitor or retailer to later change the appearance or configuration is limited.

Accordingly there is a need for a relatively inexpensive self-supporting display that provides the finished appearance of a specially designed large-depth display while also providing configuration flexibility.

DESCRIPTION OF THE DRAWINGS

FIG. 16 is an exploded perspective view of the large-depth panel display of FIG. 7.

DETAILED DESCRIPTION

Figure 11:
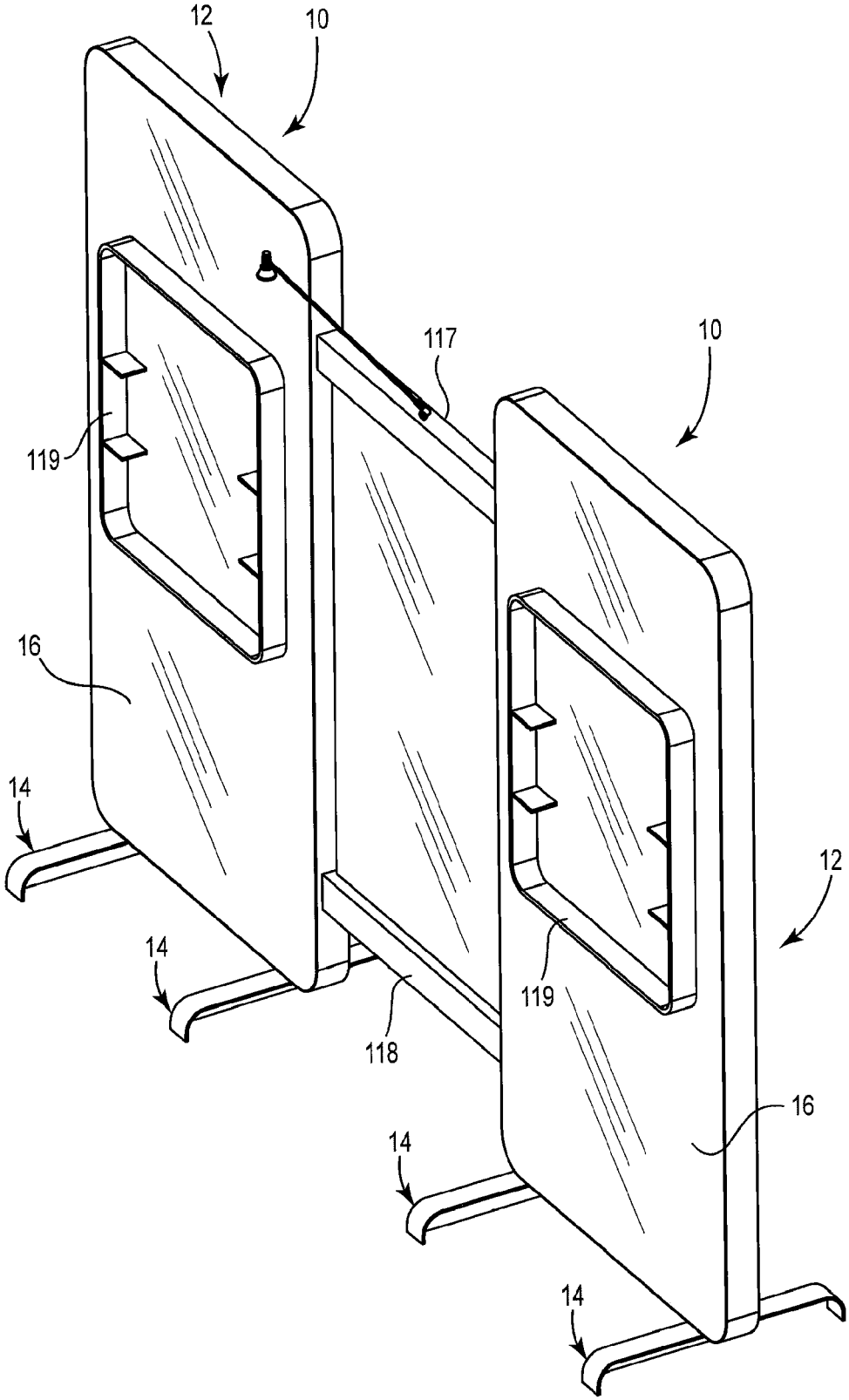
FIG. 11 is a perspective view of side-by-side full-length, large-depth panel displays with rounded corners and a rectangular frame fixture.
Figure 12:
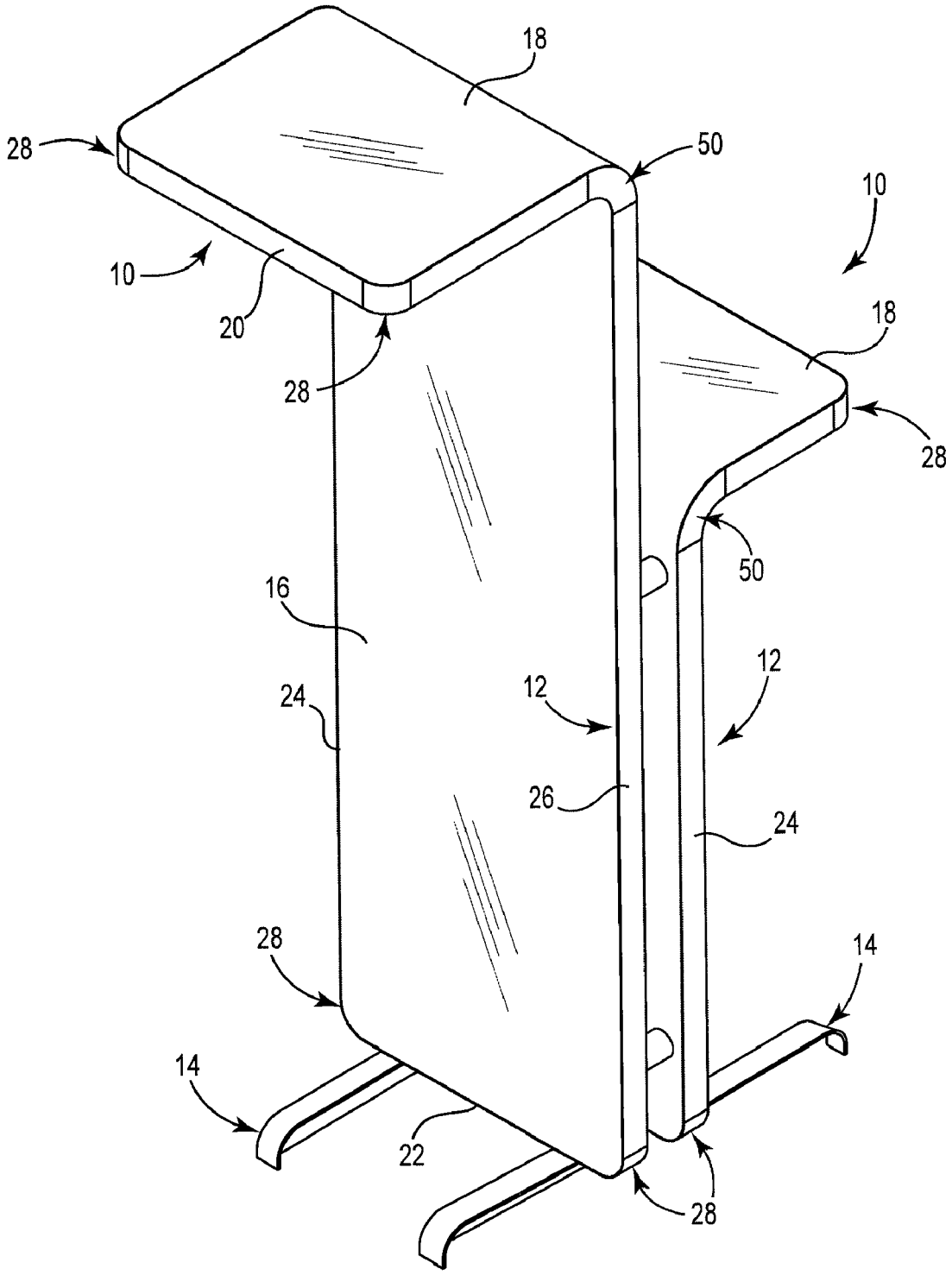
FIG. 12 is a perspective view of back-to-back full-length, large-depth panel displays with rounded corners and curved overhangs.

Referring now to the drawings, wherein like reference numerals designate identical or corresponding parts throughout the several views, FIGS. 1-10 illustrate different embodiments of a large-depth panel display designated generally by reference numeral 10. FIGS. 11-12 illustrate examples of how two or more large-depth panel displays 10 may be arranged and connected in a side-by-side manner (FIG. 11) or back-to-back (FIG. 12) for a different aesthetic appearance and/or to create a larger island display.

The preferred embodiment of the large-depth display 10 comprises a frame 12, floor supports 14, a front face panel 16 and, preferably, a rear face panel 18 (FIG. 13), although a rear face panel may not be necessary or desirable if, for example, the back of the display 10 will not be viewable.

The display panels 16, 18 are preferably removably secured to the frame 12 as discussed in greater detail later. The panels 16, 18 may be made of flexible material, such as fabric, or the panels may be made of a more rigid material, such as foam-core board, or any other desirable facing material. The exterior faces of the panels 16, 18 may include a graphic image or other desired feature.

The frame 12 preferably comprise upper and lower horizontal frame members 20, 22 and left and right vertical frame members 24, 26. The frame members are preferably rigidly connected by corner assemblies 28 thereby forming a parallelogram. The corner assemblies 28 may be rounded, squared, chamfered or have any other desired shape or configuration. Additionally, depending on the overall desired shape of the panels, the corner assemblies 28 may be greater than or less than ninety degrees, thereby enabling the panels 10 to be virtually any shape.

The depth of the frame 12 is preferably four inches, but may be any desired depth. The preferred four inch depth is primarily for aesthetic purposes, but the depth also provides sufficient space between the front and rear panels 16, 18, for added features and configurability. For example, the space between panels 16, 18 may be used to route internal wiring through the panels, or for mounting internal light fixtures for backlighting the panels, or for internal brackets for joining two displays together (see, e.g., FIGS. 11 and 12) or for mounting electronic devices (see, e.g., FIGS. 9 and 10) or to provide internal pass-through shelving space (see, e.g., FIG. 9).

Figure 21:
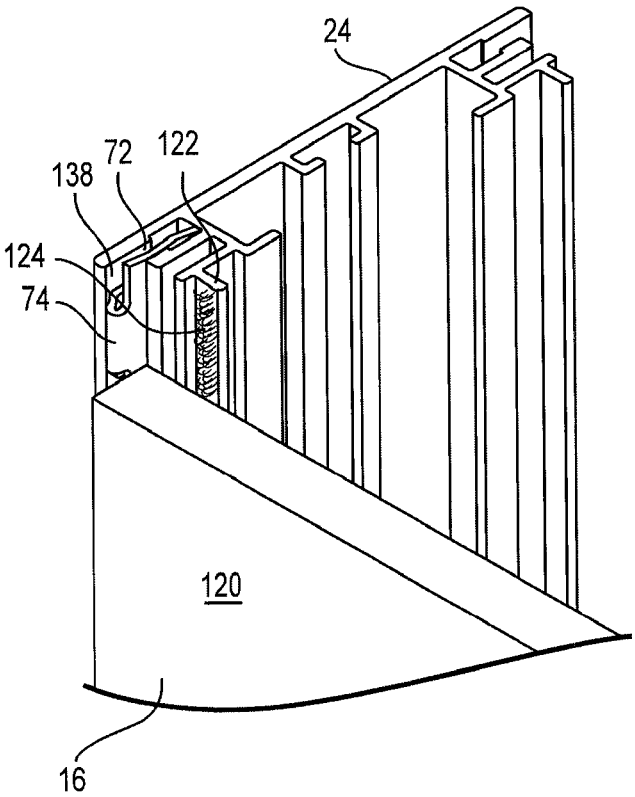
FIG. 21 is an enlarged exploded perspective view illustrating a preferred connection of a foam-core board panel to the frame.
Figure 22:
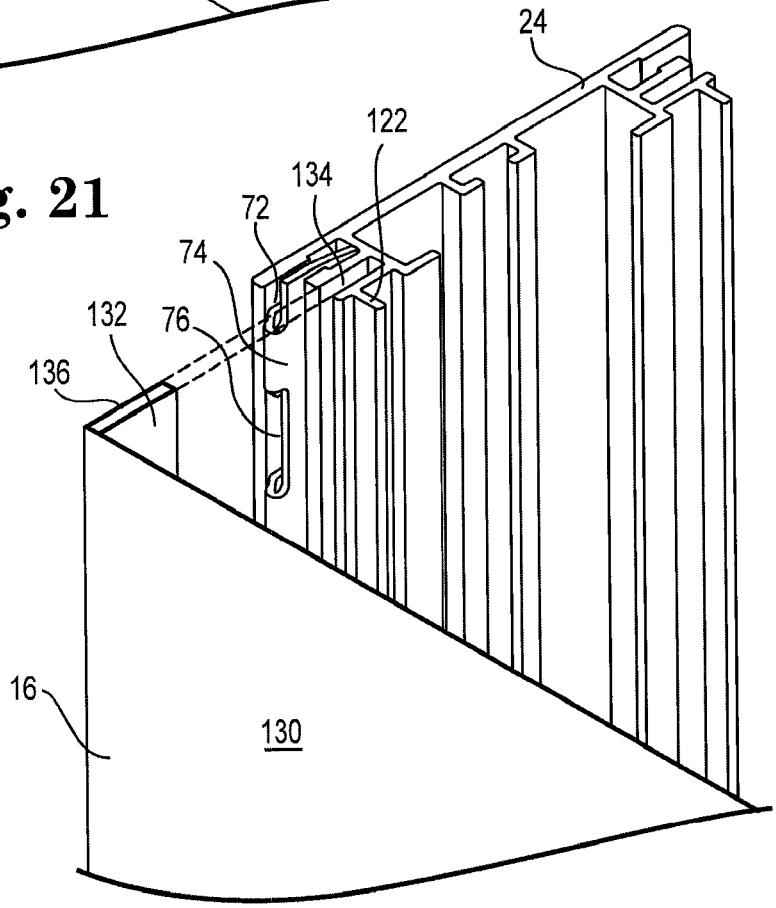
FIG. 22 is an enlarged exploded perspective view illustrating a preferred connection of a flexible panel to the frame.

The horizontal and vertical frame members 20, 22, 24, 26 are preferably extruded aluminum shapes, but the frame members may be made from any suitable material and fabricated using desired method. Aluminum, is preferred because of its lightweight and rigidity. The preferred cross-sectional extruded shape for the frame members 20, 22, 24, 26 is best illustrated in FIGS. 21 and 22.

The overall height and width of the frame 12 may vary as desired. However, to improve the affordability of the displays through reduced manufacturing costs, it is preferable to provide standard frame sizes. For example, standard frame sizes such as 2.5° high (H)×4' wide (W), 5' H×4' W and 8' H×4' W would allow considerable flexibility in configuring different displays while still allowing the displays to be easily transportable by one or two people. FIGS. 1-2 and 7-9 illustrate examples of full-length 8' H×4' W panels with different corner assemblies and other features. FIGS. 3-6 illustrate examples of different arrangements of stacked 2.5' H and 5' H panels separated by 0.5' H vertical spacer resulting in overall display height of approximately 8 feet. As with the full-length panels, different corner assemblies may be used with the shorter panels.

Figure 9:
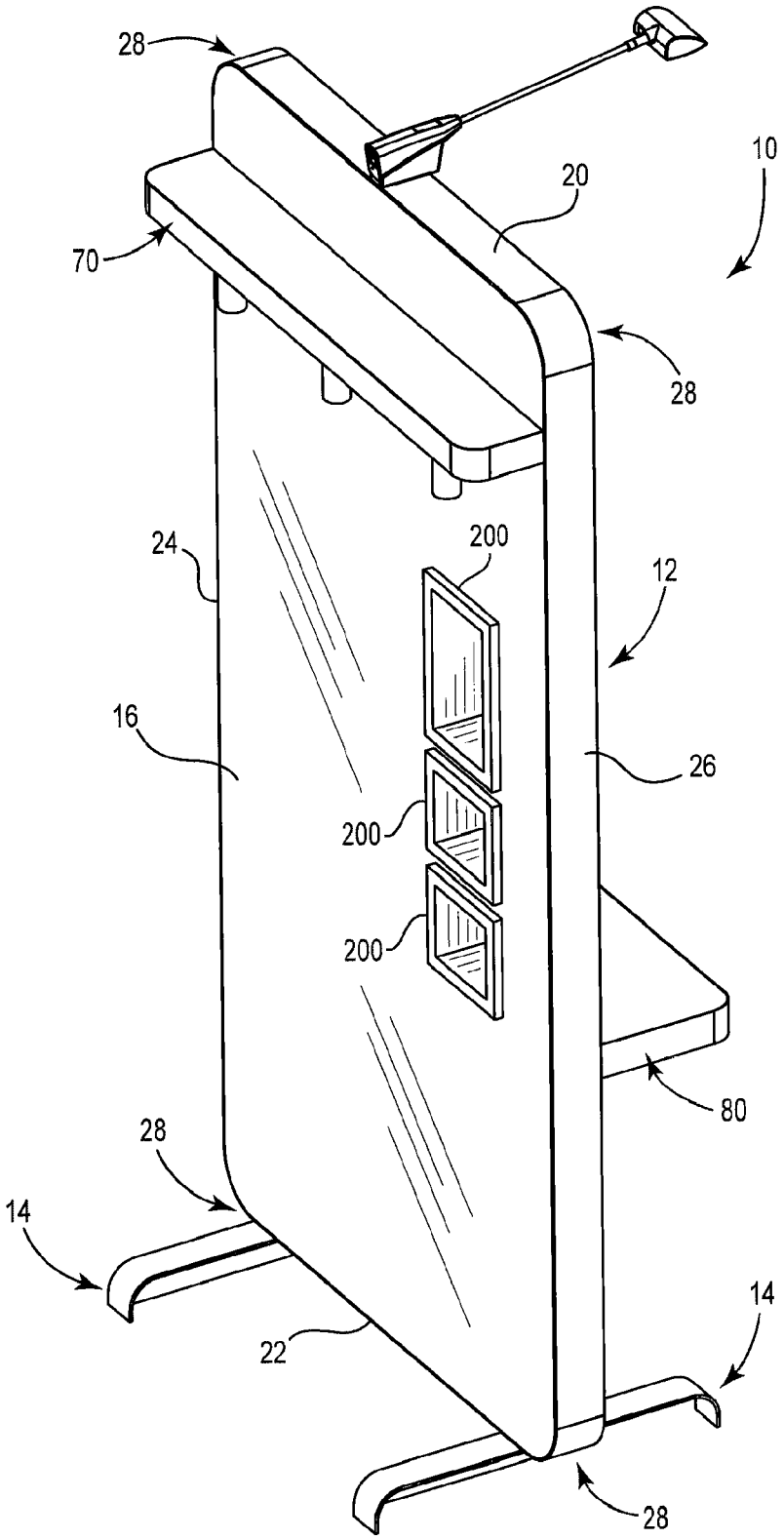
FIG. 9 is a perspective view of an another embodiment of a full-length, large-depth panel display with rounded corners, stacked pass-through boxes, an overhead fixture, a shelf fixture and a light fixture.
Figure 13:
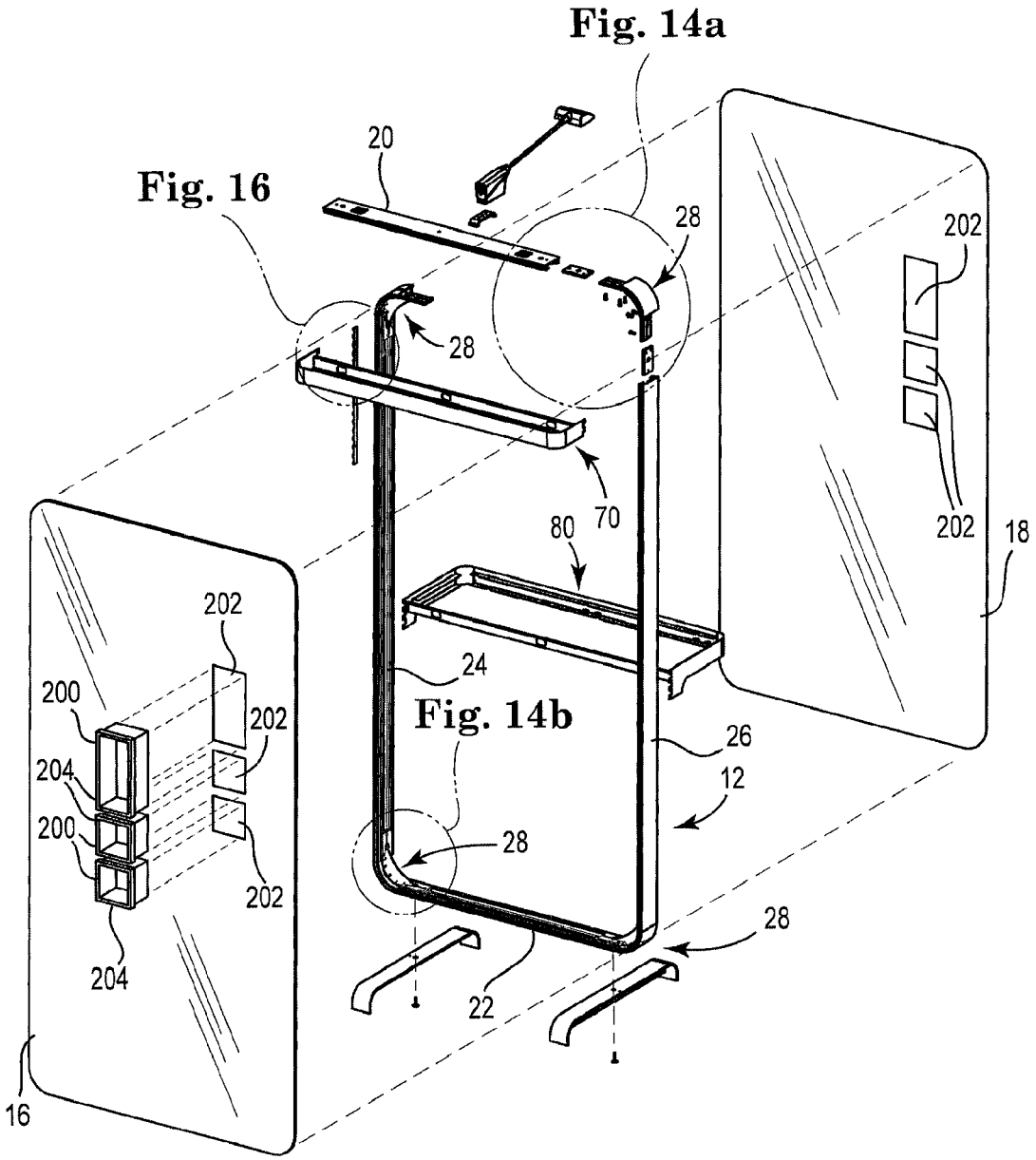
FIG. 13 is an exploded perspective view of the large-depth panel display of FIG. 9.

Referring now to FIG. 13, an exploded perspective view of the large depth panel display 10 of FIG. 9 is shown. As illustrated, the floor supports 14 are preferably secured to the bottom frame member 22 using threaded connectors. The exploded corner assembly 28 is shown in greater detail in the enlarged view of FIG. 14*a* and an assembled corner assembly is shown in greater detail in the enlarged view of FIG. 14*b*. Similarly, the connection of the overhead light fixture bracket 60 is shown in greater detail in the enlarged view of FIG. 16. FIG. 13 also illustrates the pass-through shelf boxes 200 shown in FIG. 9. The front and rear panels 16, 18 preferably include cutouts to 202 to receive the pass-through shelf boxes 200. The boxes 200 preferably have approximately the same depth as the frame 12. The boxes 200 also preferably include a frame 204 that is larger than the cutouts 202, such that the frame 204 acts as a stop against the face panel 16 to prevent the boxes 200 from being pushed through the cutouts 202. A second frame (hidden behind panel 18) is preferably attached to the opposite side of the boxes to secure the boxes 200 to the panel 18 and to prevent them from being pushed through from the back side of the display.

Figure 14A:
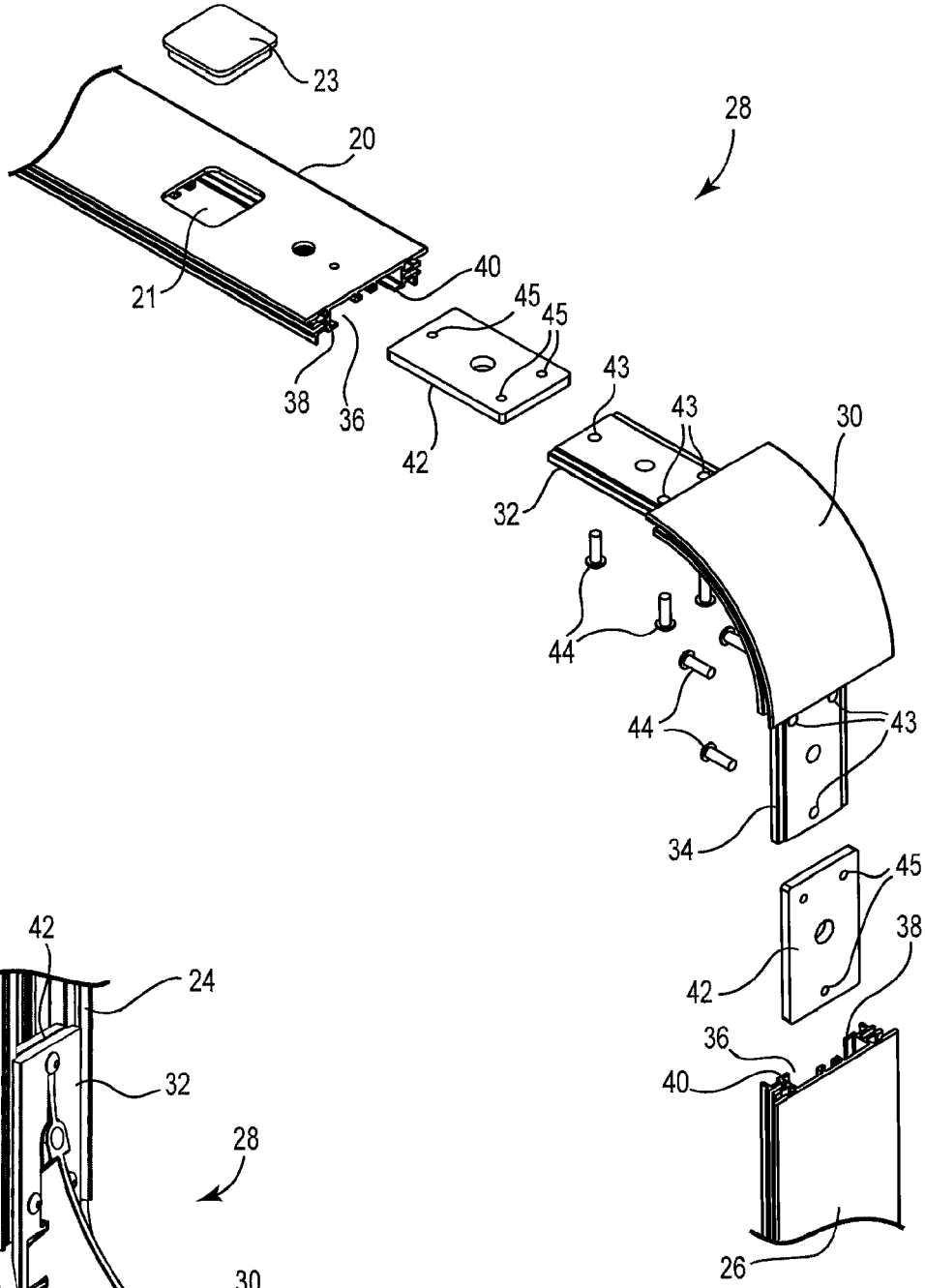
FIG. 14*a* is an enlarged exploded perspective view of the rounded corner construction of FIG. 13.
Figure 14B:
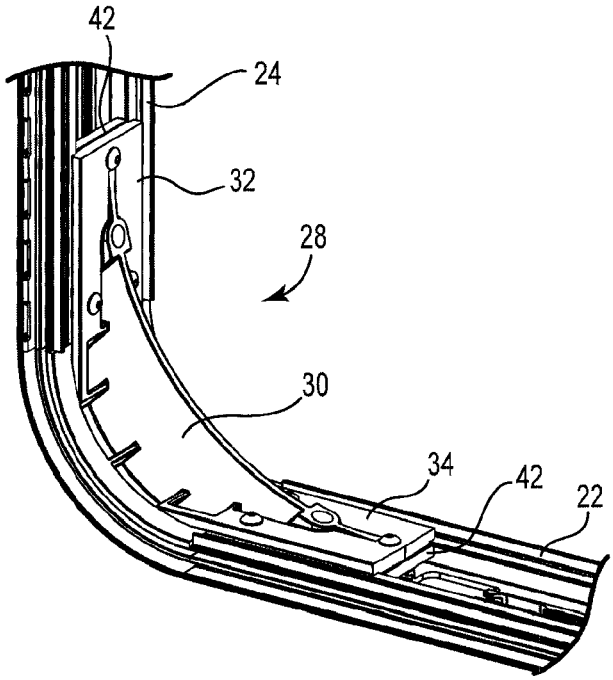
FIG. 14*b* is an enlarged perspective view of an assembled rounded corner construction of FIG. 13.

Referring to FIGS. 14*a* and 14*b*, the corner assembly 28 preferably includes a corner bracket 30 that secures to the upper frame member 20 and side frame member 26. Specifically, the corner assembly 30 includes two projecting tongues 32, 34 preferably disposed at ninety degree angles from each other. As previously identified, if other display panel shapes are desired, the tongues 32, 34 may be disposed at other angles. The frame members 20, 26 preferably include a void 36 between opposing internally projecting L-shaped flanges 38, 40. A backing plate 42 is received within the voids 36. The tongues 32, 34 are placed over the L-shaped flanges 38, 39 and the predrilled apertures 43 therein are aligned with corresponding predrilled apertures in the backing plate 45. Threaded fasteners 44 extending through the apertures 43 in the tongue 32, 34 and into the apertures 45 in the backing plate 42 draw the tongue and backing plate together thereby sandwiching the L-shaped flanges 38, 39 therebetween securely connecting the corner bracket 30 to the frame members. The same corner assembly 28 is preferably provided at each corner of the display 10. Preferably the corner brackets 30 are a die-cast zinc alloy which provides good qualities for tapping to receive threaded connectors, while still being light weight but is less expensive than aluminum die casts.

Figure 15:
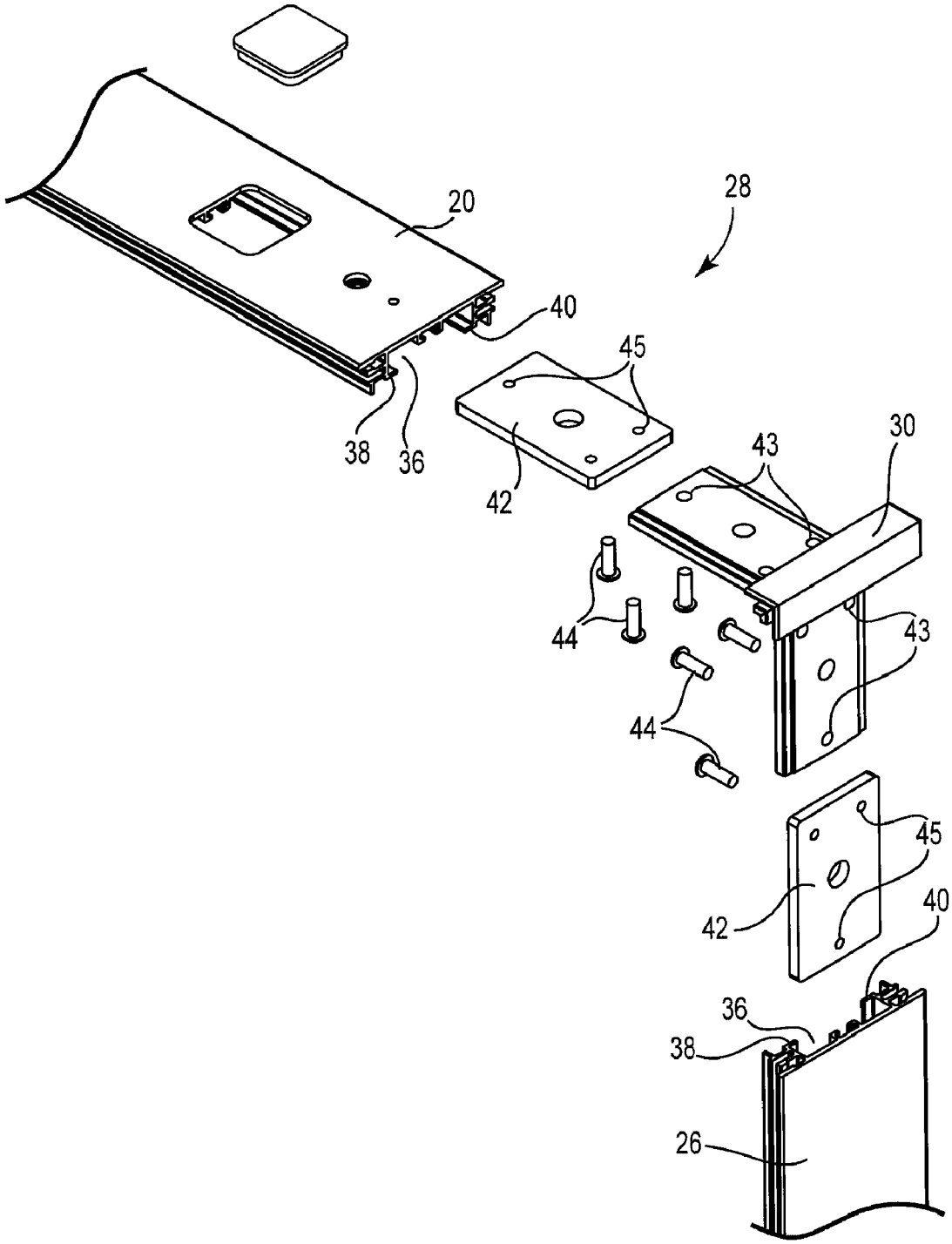
FIG. 15 is an enlarged exploded perspective view of the squared corner construction of FIG. 2.

Rather than a rounded corner assembly as shown in FIGS. 14*a* and 14*b*, a square corner assembly may be utilized as shown in FIG. 15. The corner assembly 28 of FIG. 15 is substantially identical to the corner assembly 28 of FIG. 14, except that the corner bracket 30 in FIG. 15 is square as opposed to having a radius.

Figure 7:
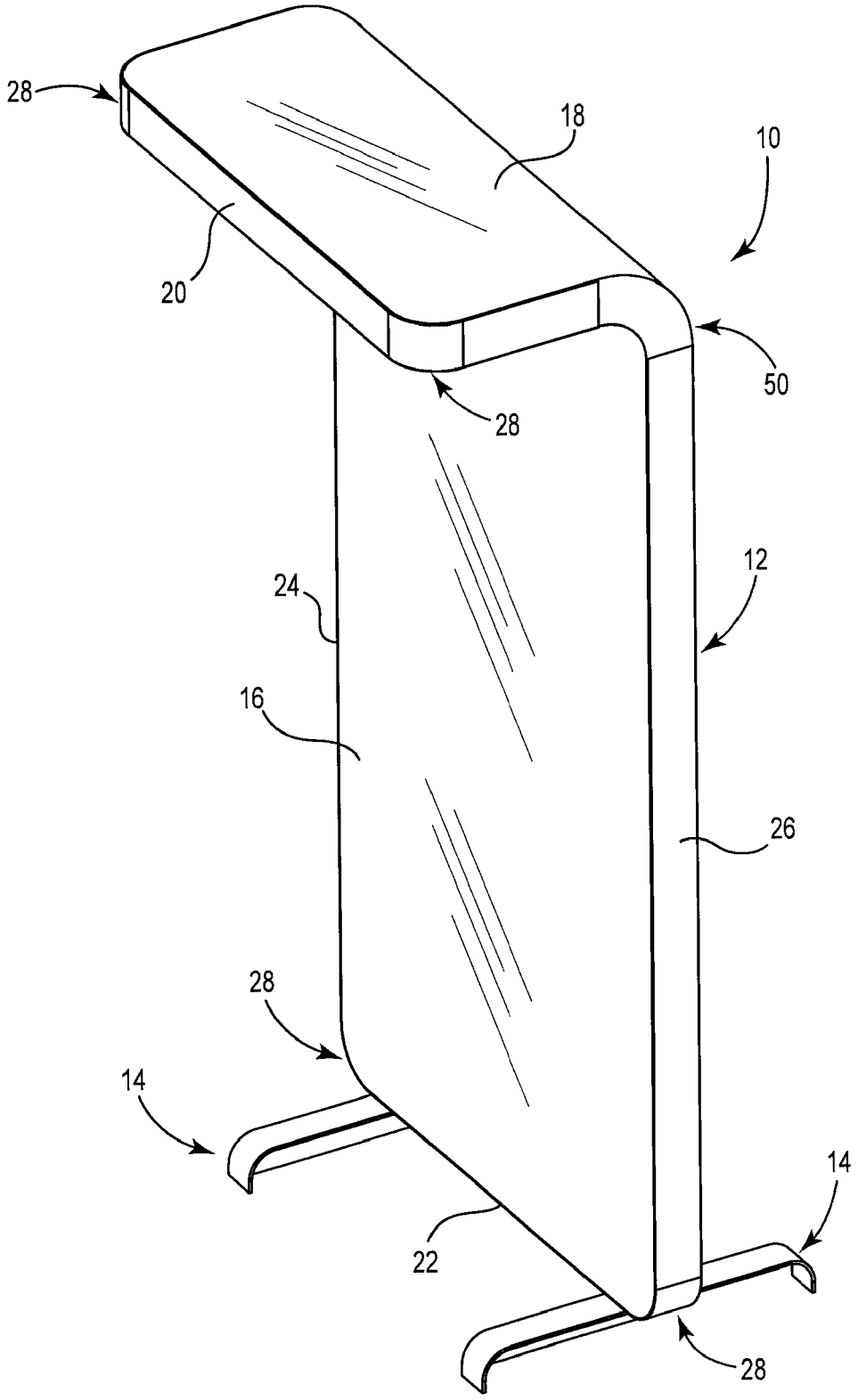
FIG. 7 is a perspective view of an another embodiment of a full-length, large-depth panel display with rounded corners and a curved overhang.
Figure 8:
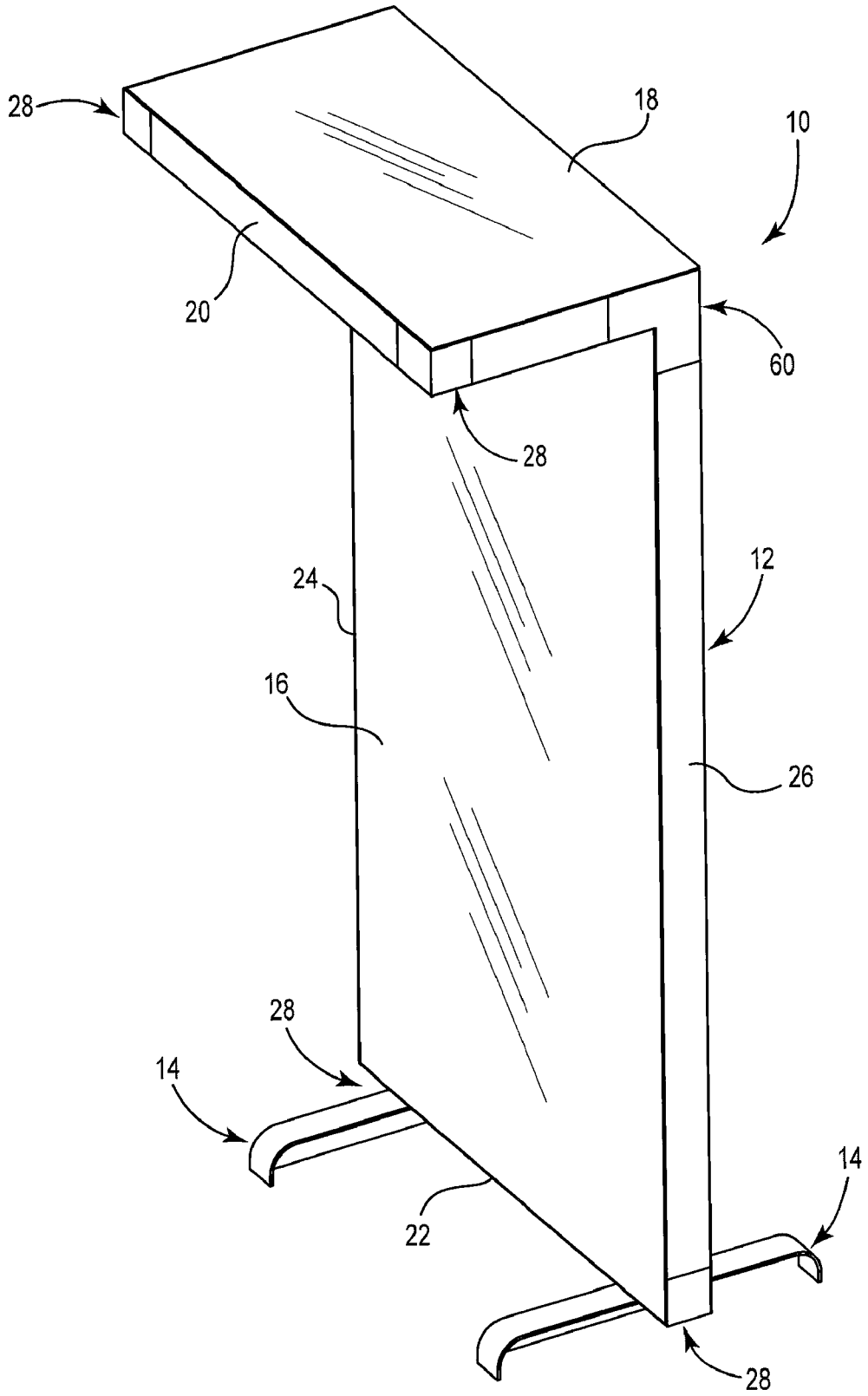
FIG. 8 is a perspective view of an another embodiment of a full-length, large-depth panel display with squared corners and a squared overhang.

The curved overhang connector assembly 50 as shown in FIG. 7 is preferably substantially identical to the curved corner assembly 28, except that instead of a horizontal radius corner bracket 30, a vertical radius corner bracket is provided such that the projecting tongues 32, 34 are in the same plane as opposed to being in perpendicular planes. Likewise, the square overhang connector assembly 60 as shown in FIG. 8 is preferably substantially identical to the curved overhang connector assembly 50 except that the square overhang connector does not have a vertical radius.

Figure 16:
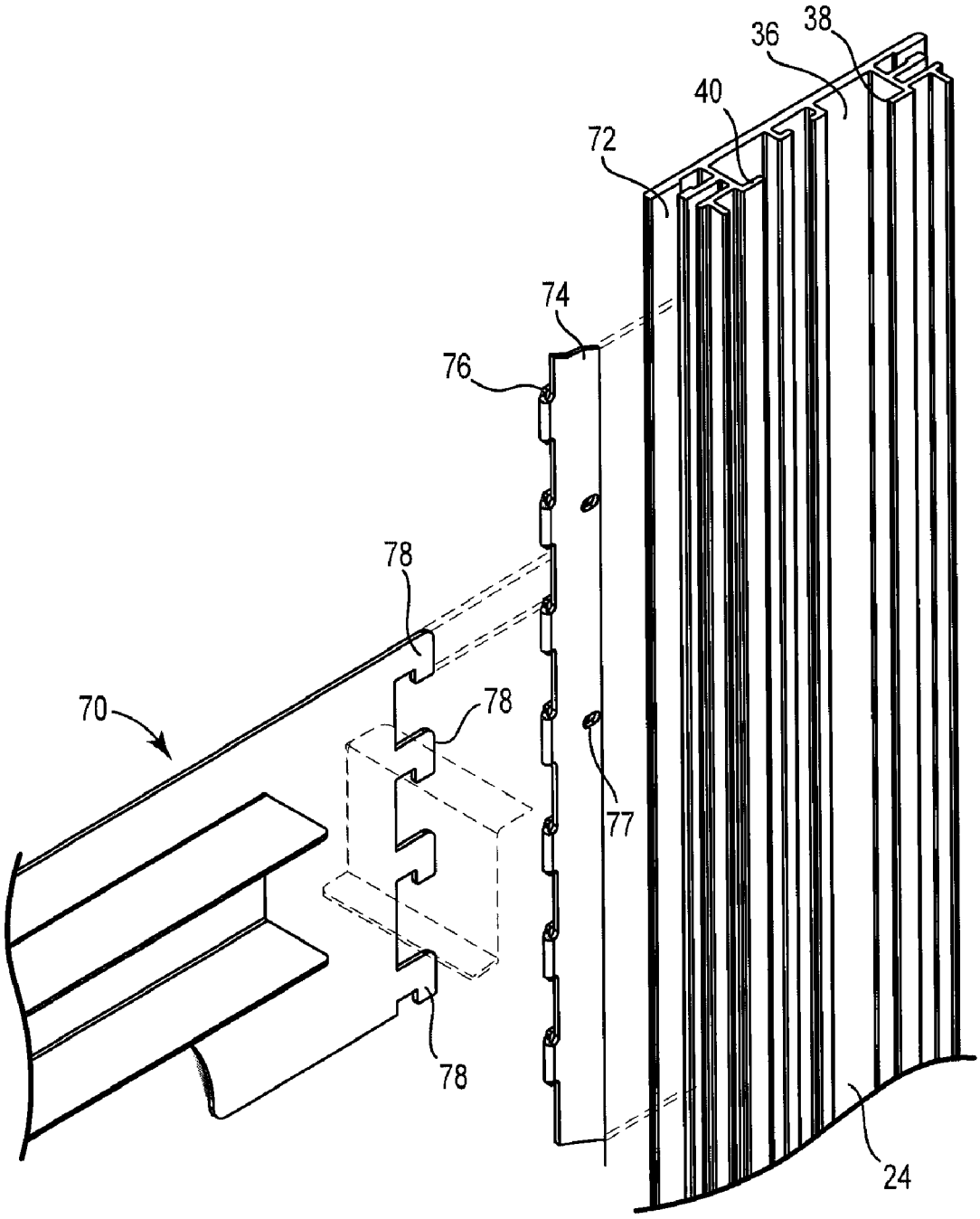
FIG. 16 is an enlarged exploded perspective view showing a preferred embodiment for attaching the light fixture bracket of FIG. 9.

FIG. 16 illustrates the preferred embodiment for attaching brackets, such as for the overhead light fixture bracket 70, to the frame 12. The frame members 20, 22, 24, 26 preferably include a channel 72 within which is received a notched plate 74 with spaced slots 76. The notched plate 74 preferably includes a series of spaced projections 77 which retain it within the channel 72. It should be appreciated that although FIG. 16 shows the notched plate 74 exploded perpendicularly from the longitudinal axis of the channel, the projections 77 require the notched plate to be inserted through the ends of the frame members prior to the attachment of the corner assemblies 28. Alternatively, the notched plate 74 could be secured within the channel 72 with tapping screws (not shown) by spot welding or other securing means. The notched plate 74 receives matingly aligned hooks 78 of the fixture bracket 70. The shelf fixture bracket 80 as shown in FIGS. 9 and 13 is preferably attached to the frame 12 in the same manner as the light fixture bracket 70.

Figure 10:
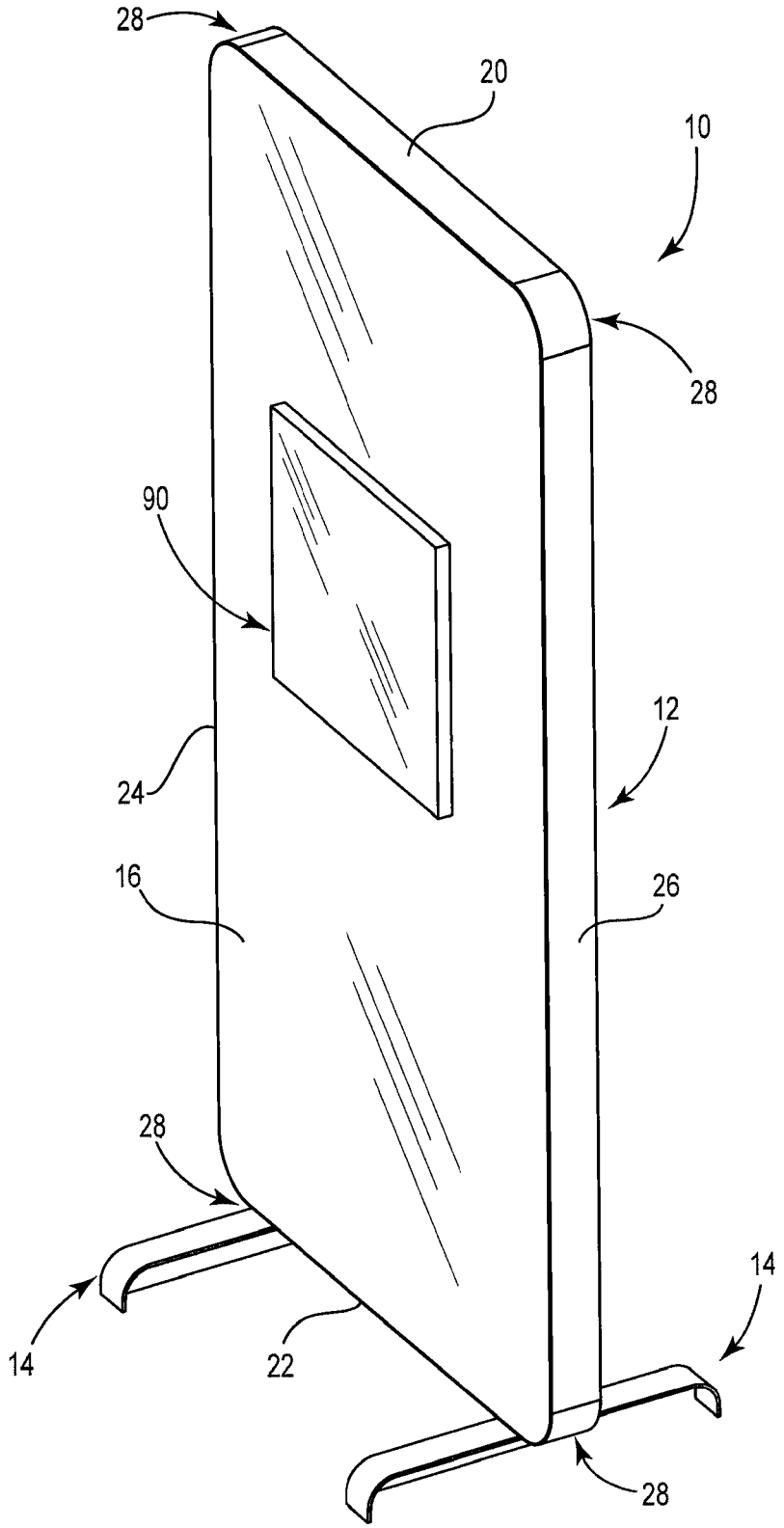
FIG. 10 is a perspective view of another embodiment of a full-length, large-depth panel display with rounded corners and a monitor or screen.
Figure 17:
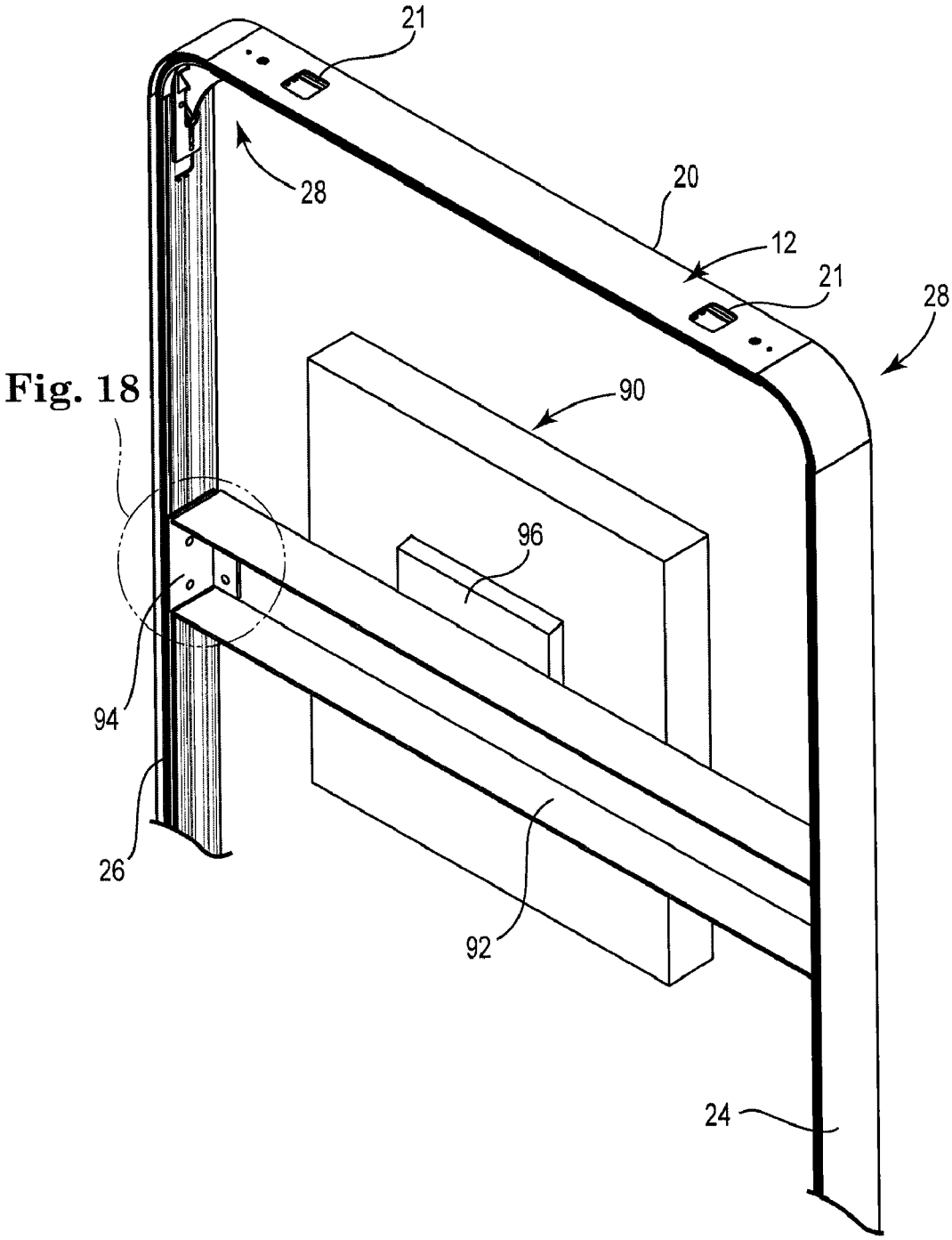
FIG. 17 is an enlarged view of the display of FIG. 10 illustrating a preferred embodiment for attaching a screen or monitor to the display.

FIG. 17 is an exploded perspective view of the panel 10 of FIG. 10 showing the preferred embodiment for attaching a monitor or screen 90 to an internal horizontal beam 92 secured at each end by a beam bracket 94. A mounting plate 95 is preferably attached to the horizontal beam 92 with threaded fasteners (not shown). The monitor or screen 90 is then preferably mounted to the mounting plate 95 by horizontal fasteners (not shown). The upper frame member 20 and lower frame member 22 (not shown in FIG. 17) may include apertures 21 through which electrical conduit, signal cables and other wiring may extend. A plug 23 (FIG. 14*a*) may be provided to cover the apertures 21 when no wiring is needed.

Figure 18:
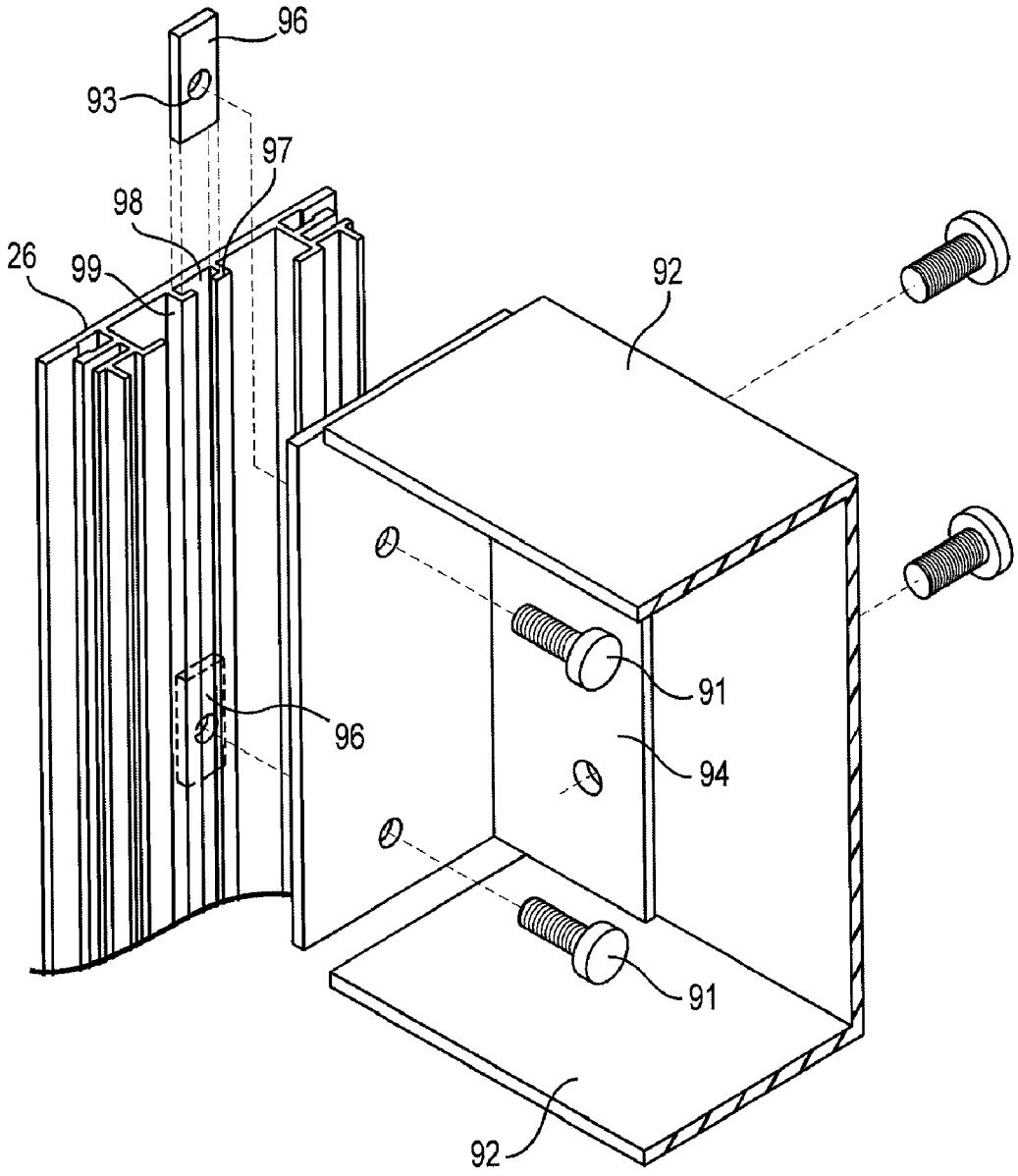
FIG. 18 is an enlarged perspective view of the area circled in FIG. 17 illustrating a preferred embodiment for attaching an internal horizontal beam to the frame.

FIG. 18 is an enlarged perspective view showing the preferred embodiment for securing the horizontal beam 92 to the frame 12. As illustrated in FIG. 18, the frame members 20, 22, 24, 26 preferably include a C-shaped slot 98 formed by two inwardly projecting L-shaped flanges 97, 99. The slot 98 slidably receives a bar 96 having a threaded aperture 93 therein. Threaded fasteners 91 extend through apertures in the beam bracket and are threadably received by the threaded apertures 93 in the bars 96 which draws the bar 96 and the beam bracket together sandwiching the L-shaped flanges 97 and 98 therebetween resulting in a secure connection.

Figure 1:
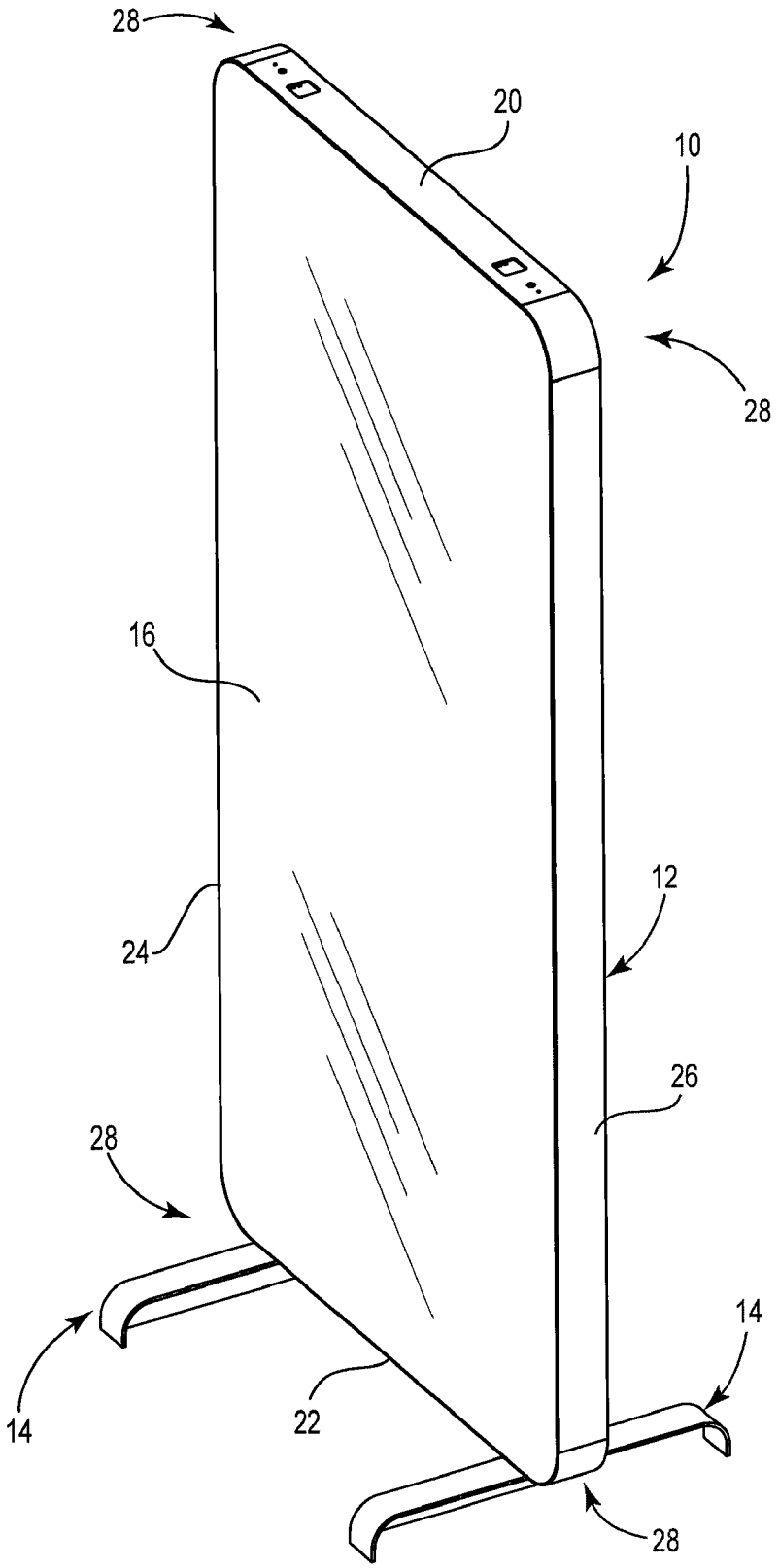
FIG. 1 is a perspective view of an embodiment of a full-length, large-depth panel display with rounded corners.
Figure 2:
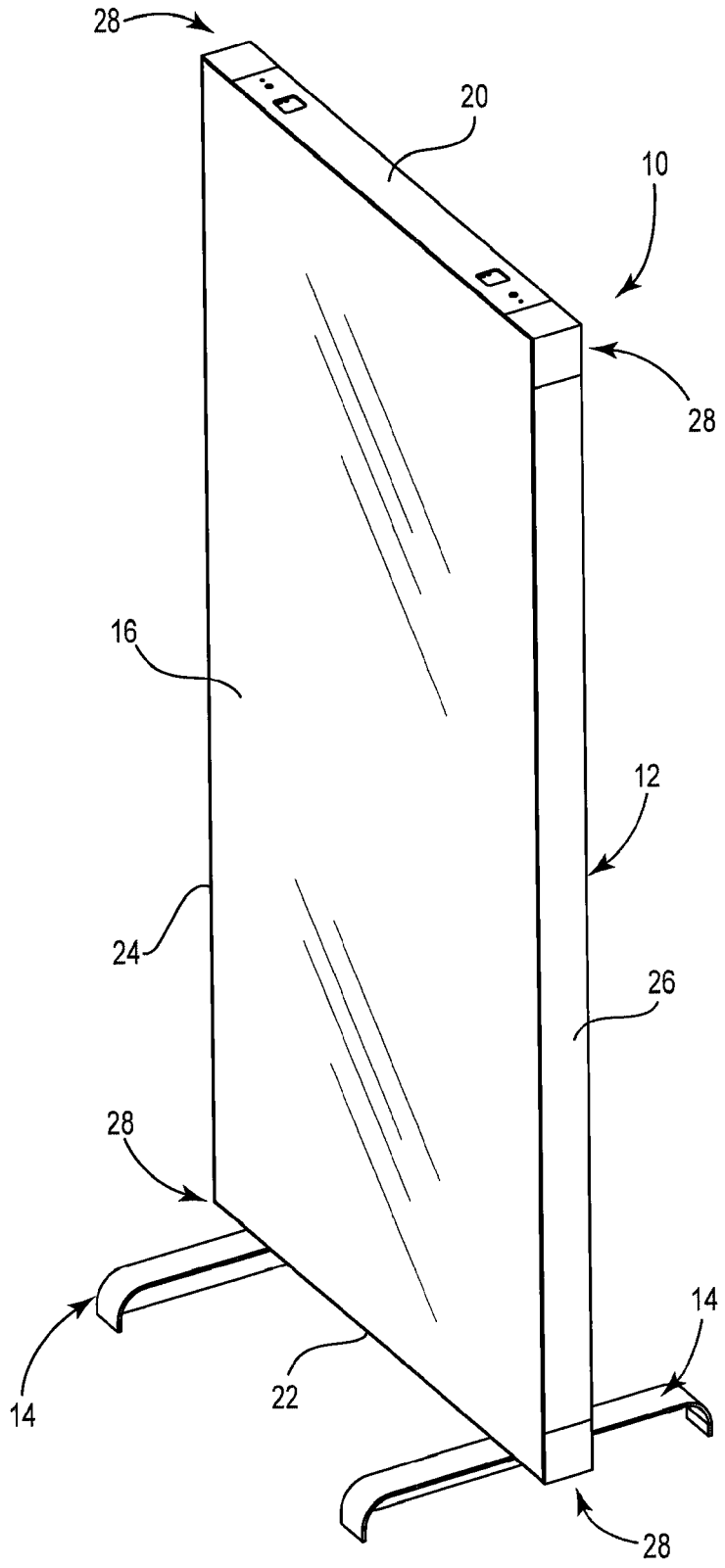
FIG. 2 is a perspective view of another embodiment of a full-length, large-depth panel display with square corners.
Figure 3:
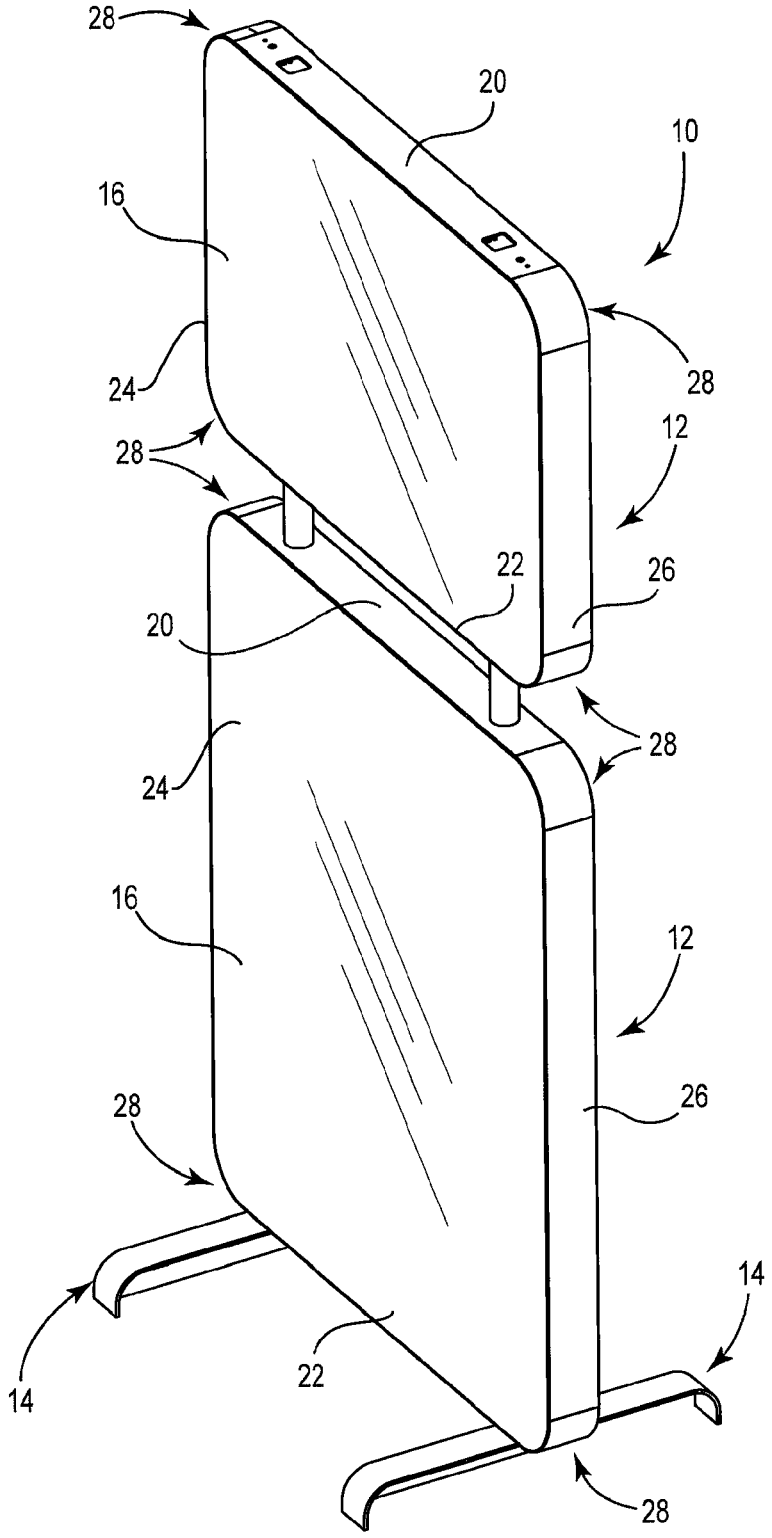
FIG. 3 is a perspective view of another embodiment of a large-depth panel display with two vertically stacked partial length panels with rounded corners.
Figure 4:
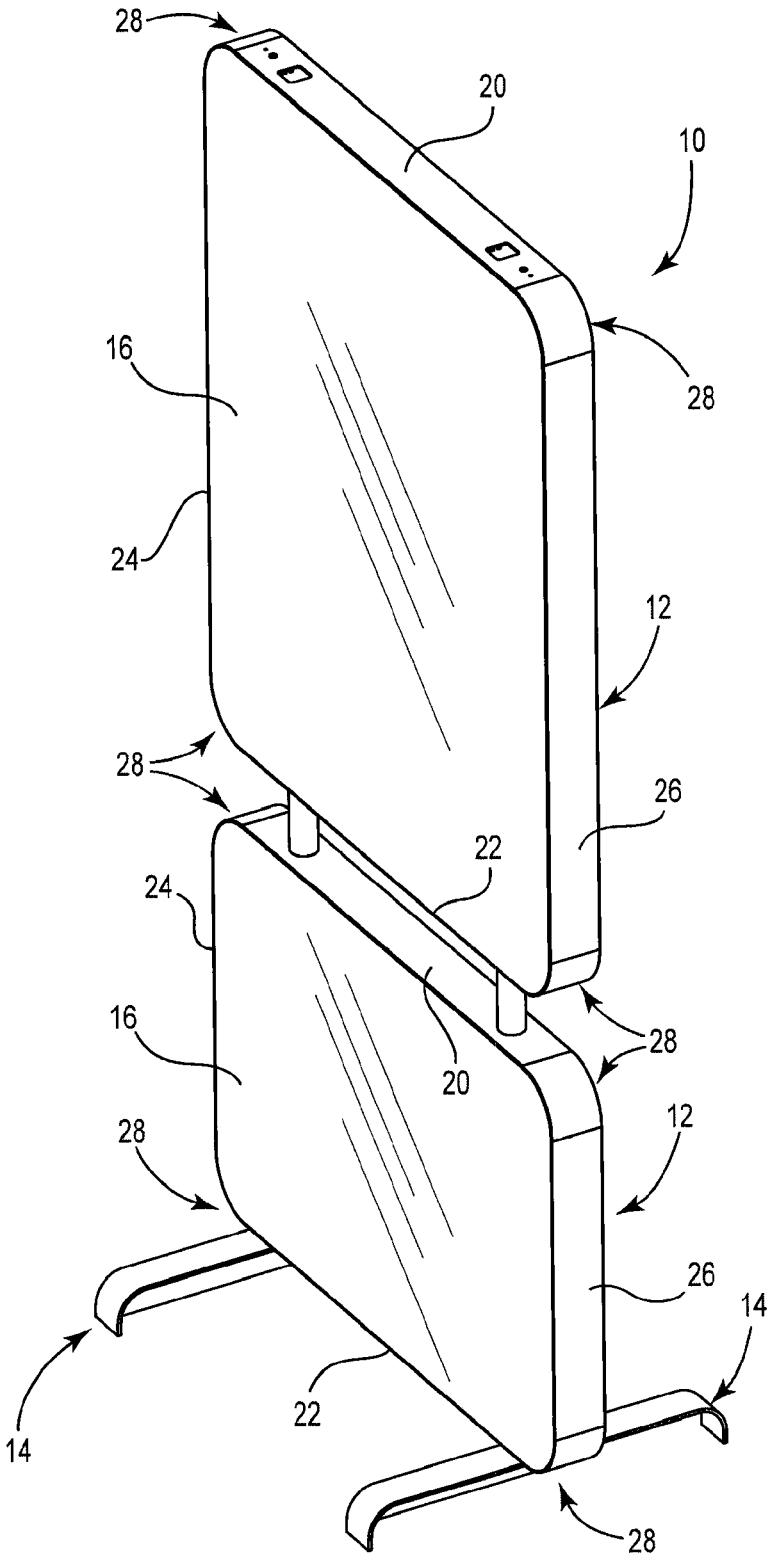
FIG. 4 is a perspective view of another embodiment of a large-depth panel display with two vertically stacked partial length panels with rounded corners.
Figure 5:
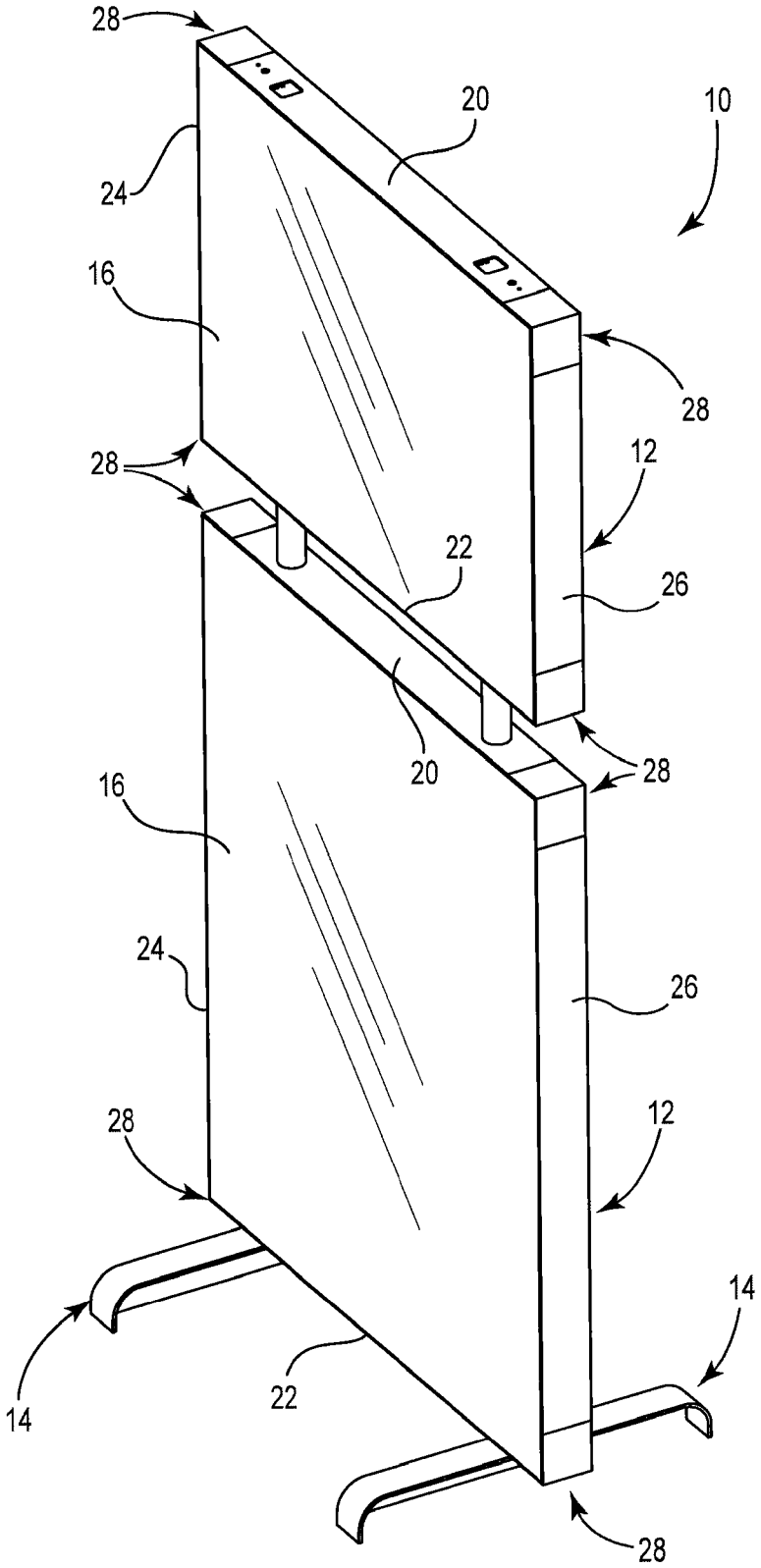
FIG. 5 is a perspective view of another embodiment of a large-depth panel display with two vertically stacked partial length panels with square corners.
Figure 6:
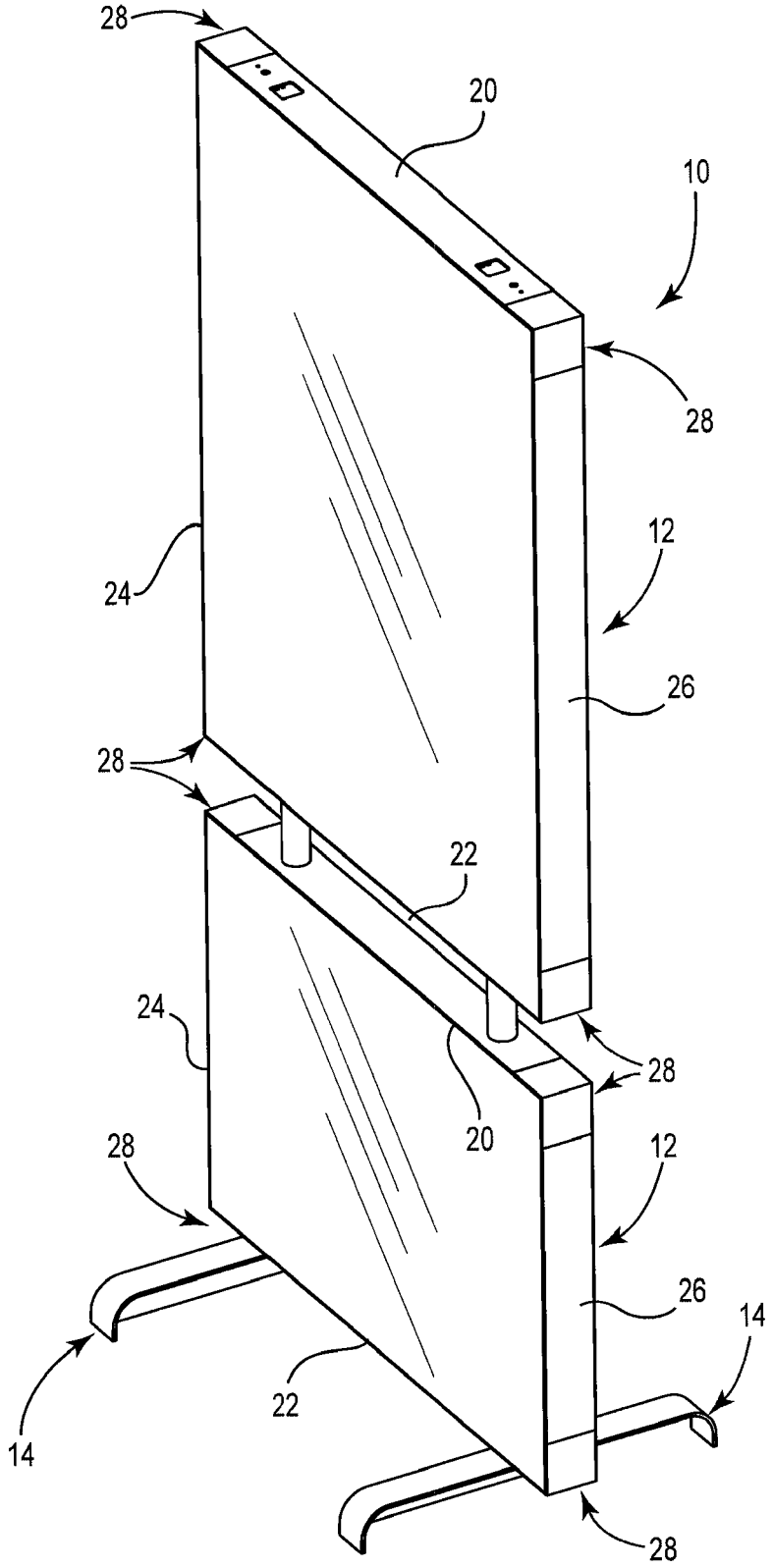
FIG. 6 is a perspective view of another embodiment of a large-depth panel display with two vertically stacked partial length panels with square corners.
Figure 19:
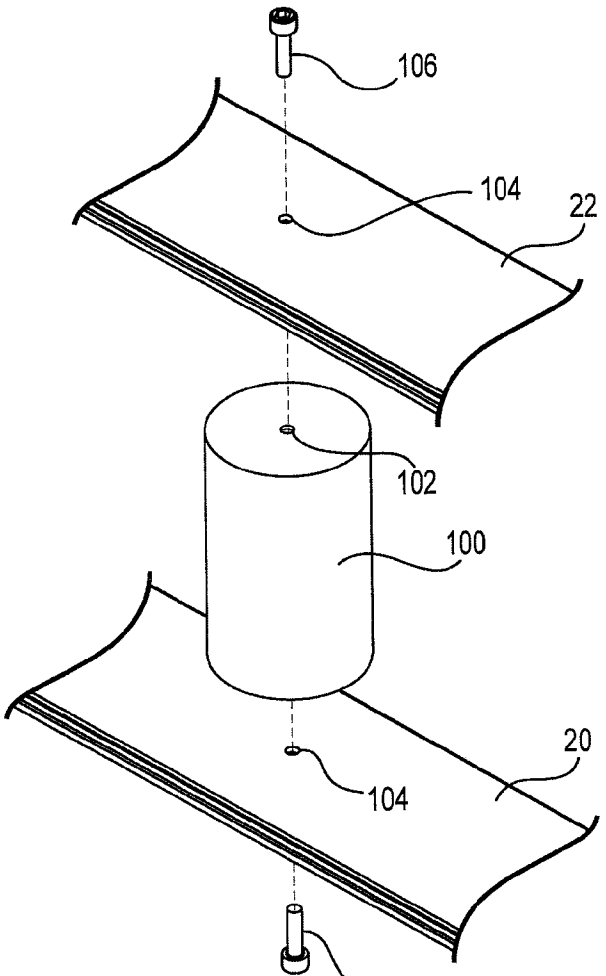
FIG. 19 is an enlarged exploded perspective view of the vertical connection of the stacked panels of FIG. 3.

FIG. 19 is an exploded perspective view of the preferred embodiment for connecting two vertically stacked display panels 10, such as shown in FIG. 3. A vertical spacer 100 having internal threads 102 at each end, is aligned with apertures 104 drilled in the upper and lower frame members 20, 22 of the vertically stacked display panels 10. Threaded connectors 106 extend through the apertures 104 and are threadably received by the internal threads 102 of the vertical spacer 100.

Figure 20:
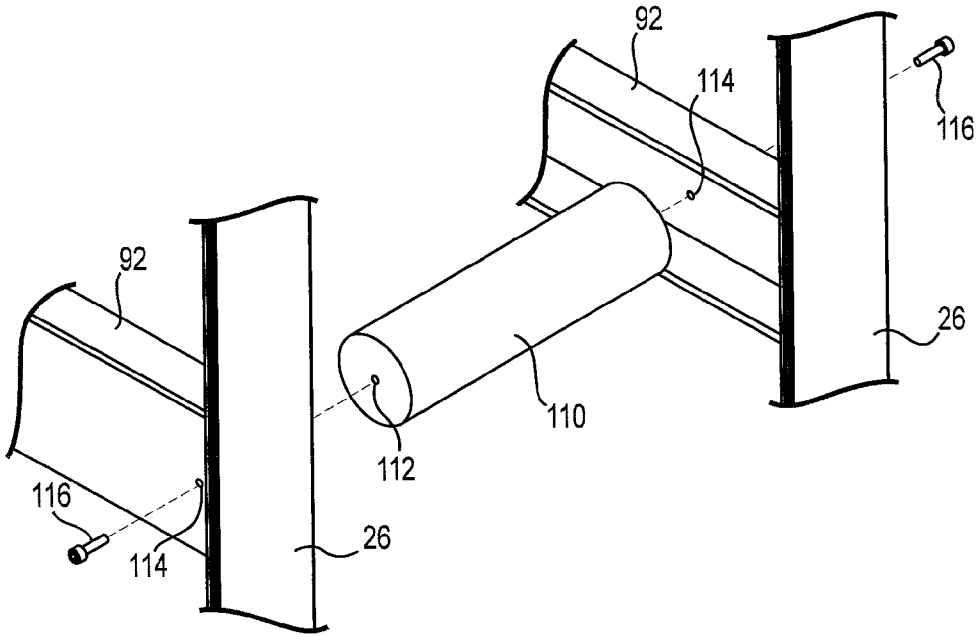
FIG. 20 is an enlarged exploded perspective view of the horizontal connection of the back-to-back panels of FIG. 12.

FIG. 20 is an exploded perspective view of the preferred embodiment for connecting two horizontally spaced display panels 10, such as shown in FIG. 12. A horizontal spacer 110 having internal threads 112 at each end, is aligned with apertures 114 drilled in an internal horizontal beam 92 secured within the frame 12 as previously described and illustrated in FIG. 18. Threaded connectors 116 extend through the apertures 114 and are threadably received by the internal threads 112 of the horizontal spacer 110.

For the side-by-side panels illustrated in FIG. 11, the upper and lower panel supports 117, 118 may include a similar internal thread (not shown) for receiving threaded connectors inserted through drilled holes in the vertical frame members 24, 26. Also it should be understood that the rectangular shelf 119 disposed on the face of the panels 16 may be secured by mounting plates and threaded connectors to an internal horizontal beam 92 (not visible in FIG. 11) as previously described in connection with FIGS. 17 and 18.

FIG. 21 illustrates the preferred embodiment for attaching a foam-core board 120 comprising the front panel 16 to the frame 12. Preferably the frame members 20, 22, 24, 26 include an internal flange 122 to which is preferably secured the hook portion 124 of a hook-and-loop fastener strip, such as Velcro®. The backside of the foam-core board 120 preferably includes the loop portion (not visible) of the hook-and-loop fastener strip. Although not shown in FIG. 21, the same type of attachment is preferably used for attaching the back panel 18 to the frame 12.

FIG. 22 illustrates the preferred embodiment for attaching a flexible panel 130, such as fabric, comprising the front panel 16 to the frame 12. As illustrated, the flexible panel 130 preferably includes an outer peripheral flange 132 that is frictionally received within a channel 134 extending around the periphery of the frame members 20, 22, 24, 26. The flange 132 is preferably comprised of a plurality of elongated rectangular flange members 136 secured to the flexible panel 130. The flange members 136 are preferably made of vinyl or other suitable material that it is lightweight, laterally rigid, yet longitudinally flexible and resilient. The flexible panel 130 may be secured to the flange members 136 by stitching, by adhesive, by providing pockets into which the flange members 136 are received or by any other suitable attaching method. As previously indicated, the flange 132 is frictionally received within the channel 134 so that the flexible panel 130 is securely yet removably secured to the frame 12. The flexible panel 130 is preferably sized such that when the flanges are inserted into the channels 134, the fabric is pulled taut and is substantially wrinkle-free. In the event it is not desired to mount shelves or other fixtures (70, 80) to the panel 10, the flange of the flexible panel 130 may be inserted into the outermost channel 72, presuming the notched plate 74 is not installed or is removed. Similarly, with the foam-core board panel 120, if the notched plate 74 is not installed or is removed, the panel 120 may be sized to extend all the way to the inside face 138 (FIG. 21) of the frame members 20, 22, 24, 26.

Figure 23:
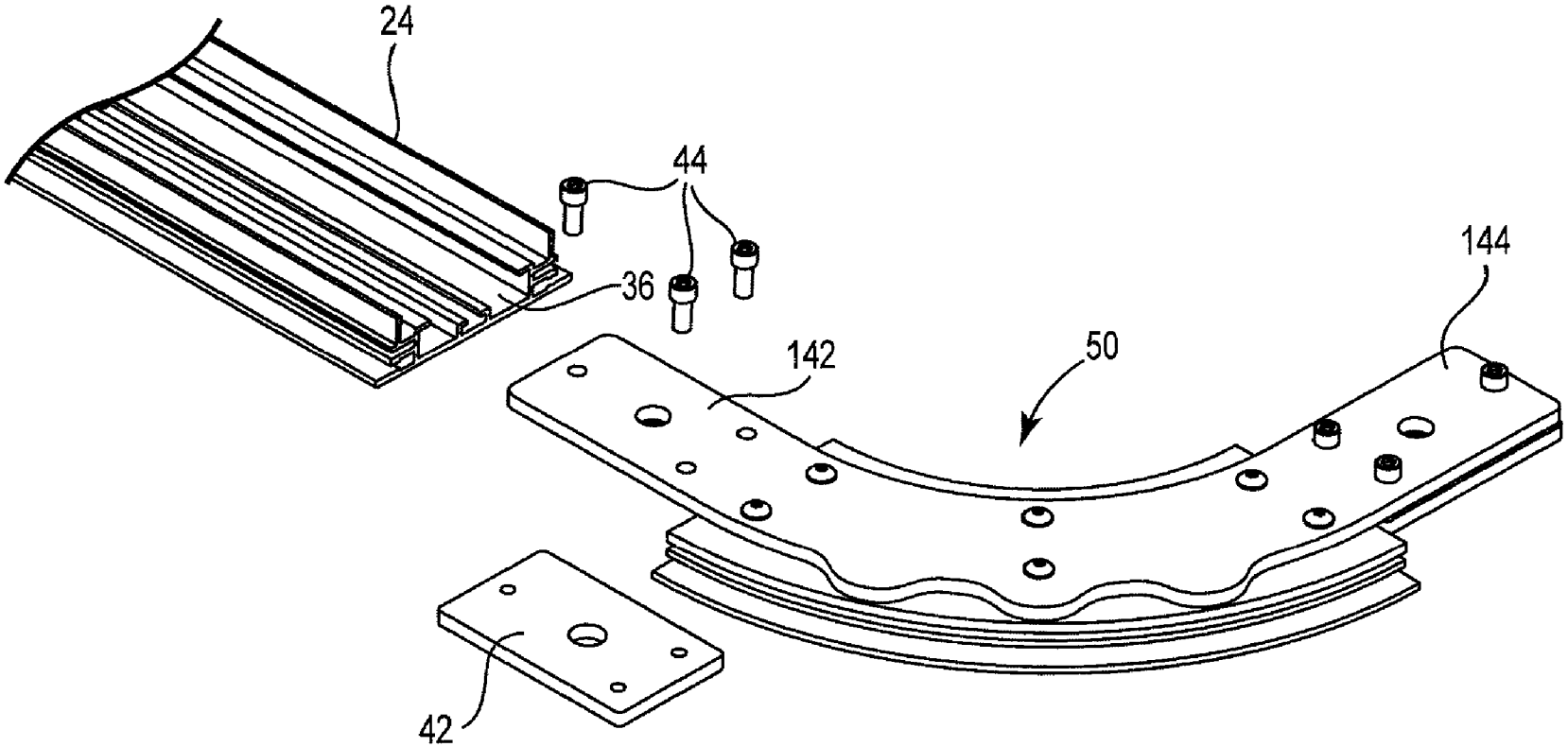
FIG. 23 is an exploded view of the overhang connector assembly shown in FIGS. 7 and 12.
Figure 24:
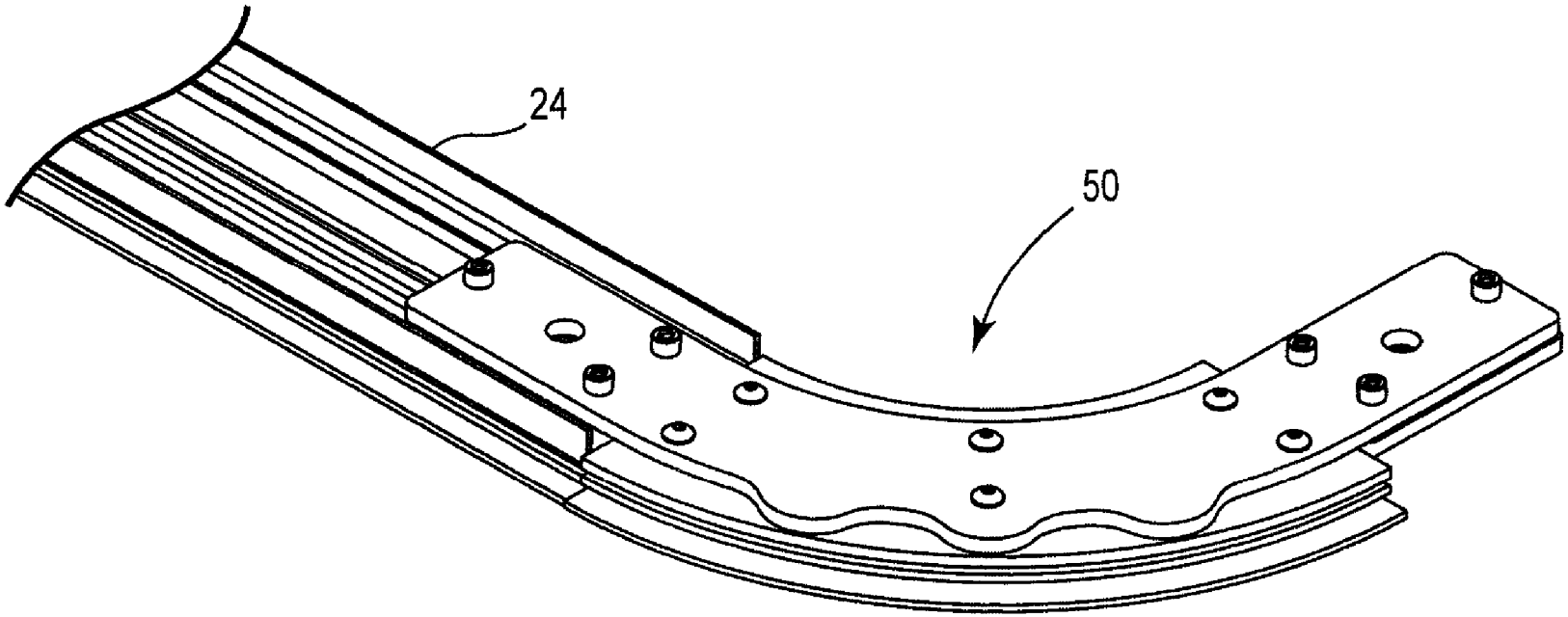
FIG. 24 is a perspective view of the overhang connector assembly of FIGS. 7, 12 and 23 as partially assembled.

As briefly discussed above in relation to FIG. 7, one configuration for the display includes an overhang section. This is accomplished utilizing an overhang connector assembly 50 which includes a vertical radiused corner. Additional detail regarding the overhang connector assembly 50 is illustrated in FIGS. 23 and 24. As shown, overhang connector assembly 50 includes projecting tongues 142, 144 which are configured substantially similar to those discussed in the various figures above. An identical backing plate 42 and identical fasteners 44 are utilized to achieve attachment of overhang connectors 50 to frame member 24. In this case, the only difference being the fact that a pair of tongues 142 and 144 extend in the same point. Again, backing plate 42 is intended to be inserted into a void 36 in frame member 24. Fasteners 44 attach to backing plate 42 and cause overhang connector 50 to be attached in the same manner as other corner assemblies, such as those discussed above in relation to FIG. 14. FIG. 24 illustrates overhang connector assembly 50 as partially assembled with one portion of a frame member 24.

Figure 25:
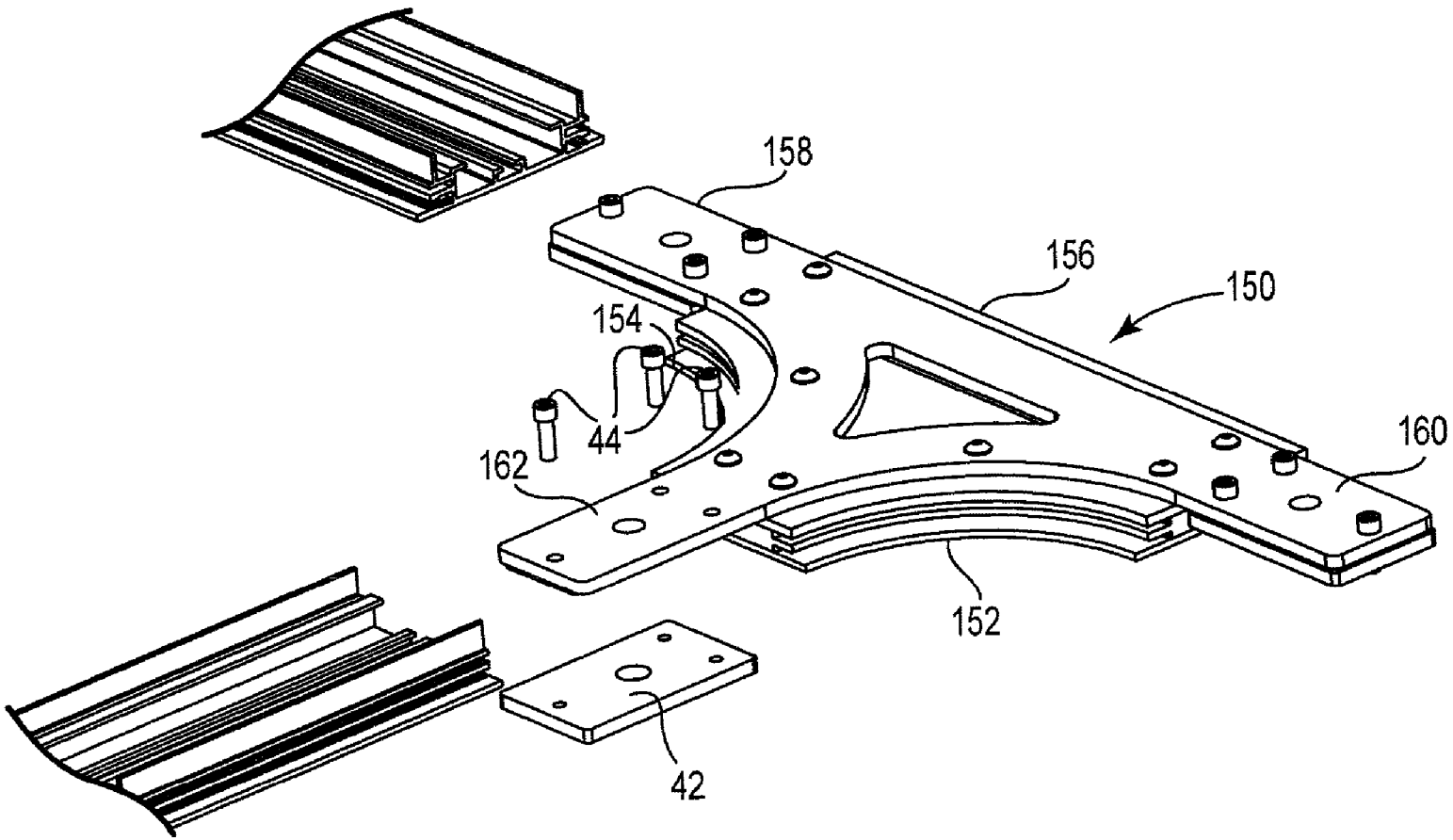
FIG. 25 is an exploded view of a split connector assembly.
Figure 26:
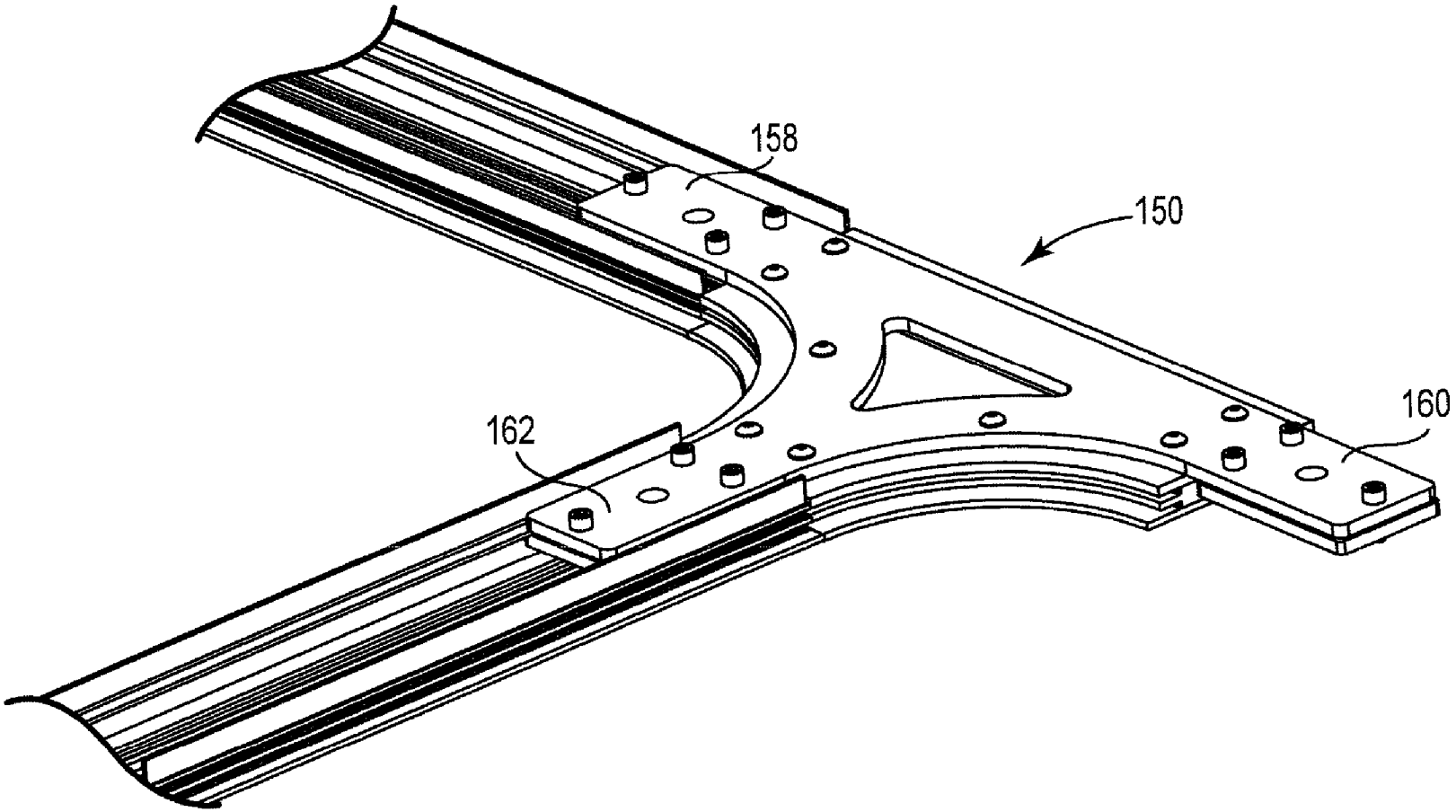
FIG. 26 is a perspective view of the split connector assembly illustrated in FIG. 25 as partially assembled.

In a manner somewhat similar to that achieved by overhang connector assembly 50, a dual overhead configuration can also be achieved by using an alternative connector assembly. Referring now to FIGS. 25 and 26, a split connector 150 is utilized for this particular double overhang configuration. As will be appreciated, this configuration will provide flexibility by allowing for overhangs on opposites sides of display panel 10. Once again, the same backing plate 42 and fasteners 44 are utilized to achieved connection between split connector assembly 150 and the various frame members. In this particular configuration, split connector assembly 150 includes two curved transition sides 152, 154 and one straight line connector side 156. This configuration will be consistent with the various curved connectors discussed above, such as overhang connector assembly 50 shown in FIGS. 7, 12, 23 and 24. Split connector assembly 150 further includes a first lateral tongue 158 and a second lateral 160 extending substantially in a straight line with one another. Additionally, a perpendicular tongue 162 extends in a direction substantially perpendicular to the other tongues. A partially assembled version of split connector assembly 150 is illustrated in FIG. 26. It is contemplated and easily recognized by those skilled in the art that additional variations of split connector assembly 150 could exist. For example, a square transition could be incorporated as opposed to the curved transition shown in FIGS. 25 and 26 above. The possibility of using different angles and in different types of geometry are also clearly possible. For example, an upward or downward angle could be used for the overhang.

Each of these variations provides additional flexibility to the designer, without the necessity for custom designing every display.

Figure 27:
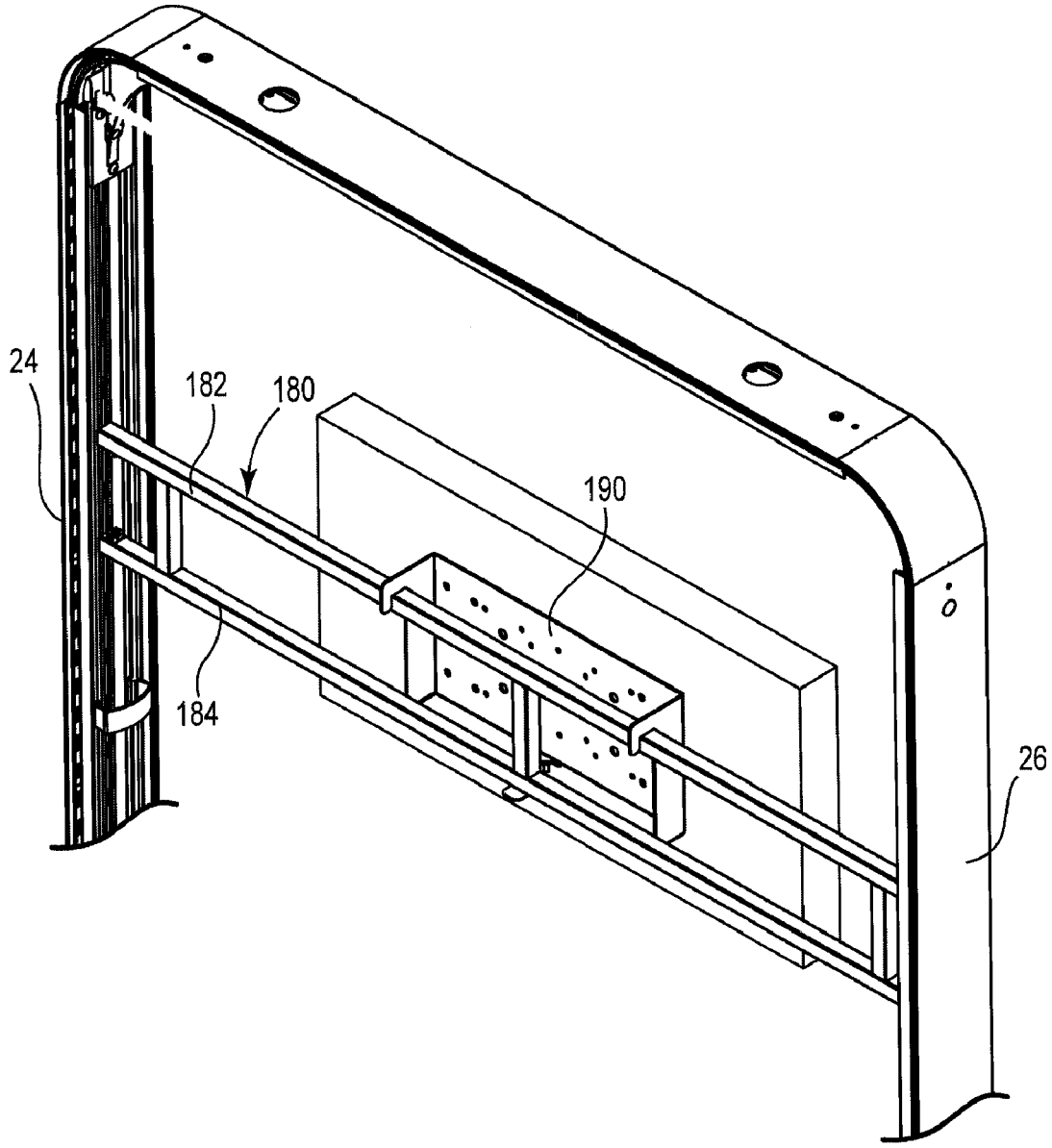
FIG. 27 is a perspective view of a spanning truss usable to support various components.

Referring now to FIG. 27, there is illustrated yet another variation of the accessories which could easily be usable in the configurable display of the present invention. Here a truss 180 is attached to a pair of frame members 24, 26 to provide a support structure. Truss 180 is configured to be attached utilizing the C-shaped slot 98 discussed above in relation to FIG. 18. In this case, each cross bar 182 and 184 is attached utilizing a necessary bar 96 (not shown) and fasteners 91. By utilizing this truss type mechanism, a bracket assembly 190 can easily be attached and suspended from truss 180. As one example, a display monitor could be hung from truss 180, and appropriately be surrounded by a panel. This provides yet another level of flexibility for use of displays.

Figure 28:
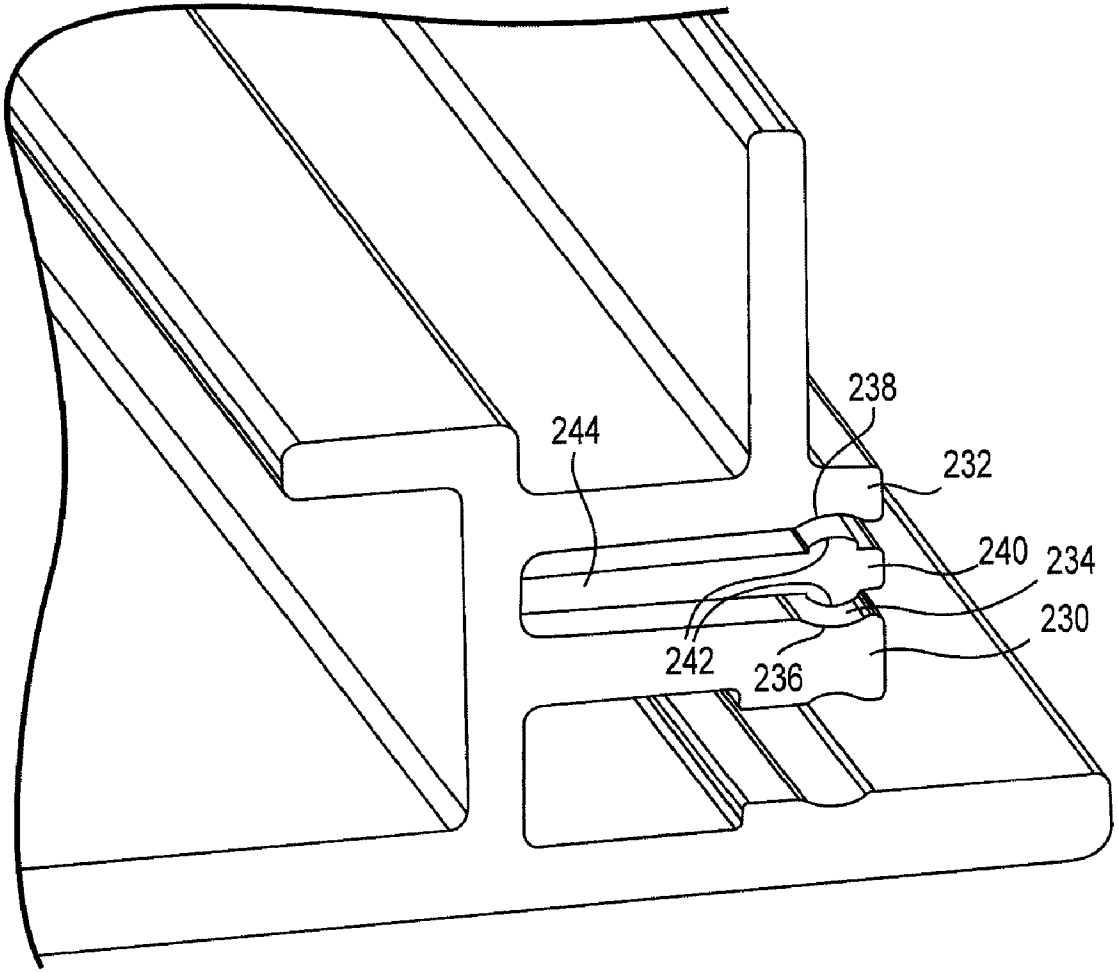
FIG. 28 is a close up view of one alternative embodiment of the panel connecting channel.
Figure 29:
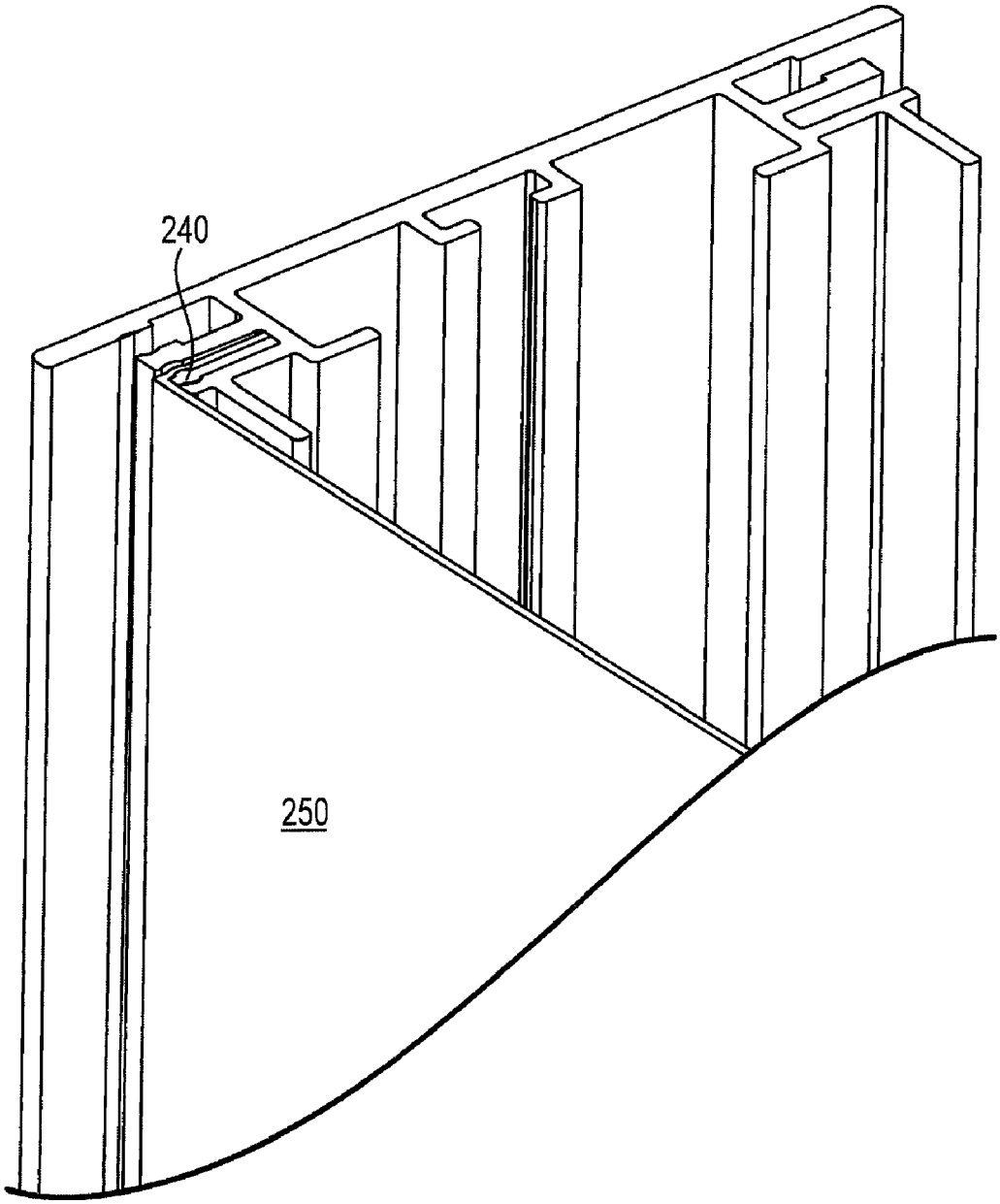
FIG. 29 is a perspective view of the alternative panel connecting channel shown in FIG. 28 having a display panel attached thereto.

Discussed above in FIG. 22 was one method of attaching flexible panel 130. The embodiment illustrated in FIG. 22 utilized a frictional coupling between a flange 132 and channel 134. The embodiment shown in FIGS. 28 and 29 utilize a slightly different configuration for attachment of a panel member. In this embodiment, a channel 234 is again created in the various frame members. Channel 234 is created by a first flange 230 and a second flange 232. In this particular embodiment, these flanges could also be portions of a more involved structure used to perform additional functions. At an outer edge of channel 234, an internal partially cylindrical recess is created by a curved surface portion 236 of first flange 230 and a second curved portion 238 of flange 232. A coupling structure of FIG. 28 further utilizes an interfering flange or tab 240 to create an interference fit between these members. As illustrated in FIG. 28, when tab 240 is inserted into channel 234, a ridged 242 will closely fill the corresponding recessed portion of channel 234. In this manner, once inserted, the physical structure of tab 240 will interfere with the physical structures of channel 234, thus appropriately capturing this component. As illustrated in FIG. 29, tab 240 is intended to be attached to a panel 250. Consequently, once tab 240 is inserted into channel 234, adjacent panel 250 is easily held in place utilizing the above referenced interference fit.

It is noteworthy that the extended or ridged portion 242 of tab 240 is positioned closer to one edge thereof. This configuration allows for the insertion of a lower portion 244 into channel 234 before actually being captured. This simplifies attachment by allowing for initial placement into channel 234, and subsequent "locking" by pressing the last portion into place.

The foregoing description is presented to enable one of ordinary skill in the art to make and use the invention and is provided in the context of a patent application and its requirements. Various modifications to the preferred embodiment of the apparatus, and the general principles and features of the system and methods described herein will be readily apparent to those of skill in the art. Thus, the present invention is not to be limited to the embodiments of the apparatus, system and methods described above and illustrated in the drawing figures, but is to be accorded the widest scope consistent with the spirit and scope of the appended claims.

The invention claimed is:

1. A large depth panel display, comprising:

a frame having adjoining frame members secured with a corner assembly, the corner assembly comprising a corner bracket having tongues extending outwardly at a predetermined angle, the tongues removably secured to the adjoining frame members;

at least one floor support attached to a bottom portion of the frame to provide lateral support; and a face panel enclosing said frame and removably secured to said frame, the face panel comprising a graphical display;

wherein the adjoining frame members have a substantially smooth outer surface and an inner surface having a plurality of grooves, wherein the face panel is removably secured to the frame members using a surface facing groove, and wherein the tongues of the corner;

wherein the frame further has a plurality of backing plates which are removably attachable to the tongues of the corner assemblies, wherein the backing plates are configured for insertion into a void in the frame members created by opposing internally projecting L-shaped flanges, thereby causing a portion of the L-shaped flanges to be sandwiched between the tongues and the backing plates; and wherein the frame members further comprise a centrally located C-shaped slot for receiving a bar therein, the bar having an aperture therein for receiving a fastener, wherein additionally accessories can be attached to the frame members using the fastener to produce a force which will sandwich portions of the C-shaped slot between the bar and the accessory.

2. The large depth panel display of claim 1 wherein the accessory is an internal frame member used to support an additional element.

3. The large depth panel display of claim 1 wherein the accessory is a framework used to support a pass-through shelf box.

4. The large depth panel display of claim 2 wherein the additional element is selected from the group consisting of a support for a display monitor, a shelf, a pass-through shelf box, a light fixture, a shelf box, a supporting truss and a spacer.

5. A configurable large-depth panel display, comprising:

a plurality of frame members, wherein each frame member is substantially linear and has a substantially constant cross-sectional configuration;

a plurality of corner brackets configured to be removably attached to an adjacent pair of frame members, the corner brackets each having a pair of tongues extending in predetermined directions configured for attachment to the frame members, wherein the plurality of frame members and the plurality of corner brackets create a continuous frame having a predetermined configuration;

a floor support attached to a bottom portion of the continuous frame to allow the continuous frame to stand in a predefined orientation; and a face panel removably secured to the continuous frame by interacting with an attachment portion of the frame members, said panel comprising a graphical display;

wherein corner brackets further comprise a backing plate removably coupled to the tongues, and wherein the constant cross-sectional configuration of the frame members has a pair of L-shaped flanges extending from an inner side thereof creating void, the backing plates being insertable into the void, wherein tightly coupling the tongues to the backing plates causes portions of the L-shaped flanges to be sandwiched therebetween; and wherein the constant cross-sectional configuration of the frame members further has a centrally located C-shaped slot for receiving a bar therein, the bar having an aperture therein for receiving a fastener, wherein an accessory can be attached to the frame members using the fastener to produce a force which will sandwich portions of the C-shaped slot between the bar and the accessory.

6. The configurable large-depth panel display of claim 5 wherein the accessory is selected from the group consisting of a support for a display monitor, a shelf, a pass-through shelf box, a light fixture, a shelf box, a supporting truss and a spacer.

7. The configurable large-depth panel display of claim 5 wherein the C-shaped slot and the void are substantially parallel with one another and aligned such that the C-shaped slot does not interfere with the backing plate when inserted into the void.

8. A configurable large-depth panel display, comprising:

a plurality of frame members, wherein each frame member is substantially linear and has a substantially constant cross-sectional configuration;

a plurality of corner brackets configured to be removably attached to an adjacent pair of frame members, the corner brackets each having a pair of tongues extending in predetermined directions configured for attachment to the frame members, wherein the plurality of frame members and the plurality of corner brackets create a continuous frame having a predetermined configuration;

a floor support attached to a bottom portion of the continuous frame to allow the continuous frame to stand in a predefined orientation; and a face panel removably secured to the continuous frame by interacting with an attachment portion of the frame members, said face panel comprising a graphical display;

wherein the constant cross-sectional configuration of the frame members further has a bracket channel at an edge thereof for receiving a notched plate.

9. A supporting frame having a predetermined configuration for use in creating a large-depth panel display capable of supporting display panels and various accessories, comprising:

a plurality of substantially linear frame members, each having a planar outer surface of a predetermined depth and similar cross-sectional configuration, wherein the cross-sectional configuration includes a pair of L-shaped flanges extending from an inner side creating a void therebetween, a centrally located C-shaped slot aligned within and substantially parallel with the void but having a height smaller than the void, the C-shaped slot capable of receiving a bar therein for supporting the attachment of an accessory, the frame member further having a bracket channel at an edge thereof opening in a direction normal to the planar outer surface capable of receiving a notched bracket therein, a facing channel adjacent the bracket channel configured to receive a flange extending from a face panel, and a flange with a supporting surface normal to the planar outer surface, the supporting surface capable of supporting a display panel;

a plurality of corner brackets each having a pair of tongues and removably coupled backing plates, wherein the backing plates are configured to be received with the void of frame members such that the backing plates and the tongues sandwich a portion of the L-shaped flanges therebetween when the backing plates and tongues are coupled at a sufficient tightness, wherein the plurality of corner brackets and the plurality of substantially linear frame members form the supporting frame of predetermined configuration when coupled to one another; and a floor support attached to a bottom frame member to allow the framework to stand in a predefined orientation.

10. The supporting frame of claim 9 further comprising a plurality of coupling members attached to at least one frame member, and a second framework attached to the coupling members, wherein the second framework is formed from a second plurality of linear frame members and a second plurality of corner brackets, thereby creating a framework capable of supporting two separate panels.

11. The supporting frame of claim 9 wherein the plurality of corner brackets include four corner brackets each having the respective tongues oriented in planes arranged substantially normal to one another thereby creating a predetermined configuration which is substantially rectangular.

12. The supporting frame of claim 11 wherein the plurality of corner brackets further include two corner brackets having the respective tongues oriented in a single plane and extending at an angle with respect to one another thereby creating a predetermined configuration which supports additional face panels oriented in multiple planes.

13. The supporting frame of claim 9 wherein the plurality of frame members each have a facing channel opening in a direction parallel to the planar outer surface for receiving a flange extending from the face panel.

14. The supporting frame of claim 13 wherein the flange extending from the face panel is held within the facing channel via a compression fit.

15. The supporting frame of claim 13 wherein the flange extending from the face panel is held within the facing channel via an interference fit.

16. The supporting frame of claim 15 wherein the facing channel has an internal cylindrical recess, and the flange extending from the face panel has a ridge configured to be closely contained within the internal cylindrical recess, thereby creating the interference fit.

* * * * *